US011814265B2

(12) United States Patent
Holzer et al.

(10) Patent No.: US 11,814,265 B2
(45) Date of Patent: Nov. 14, 2023

(54) SPEED LIMITER FOR A LIFTING GEAR HAVING BRAKE ACTUATED BY CENTRIFUGAL FORCE

(71) Applicant: Wittur Holding GmbH, Wiedenzhausen (DE)

(72) Inventors: René Holzer, Scheibbs (AT); Leopold Latschbacher, Gresten (AT); Christoph Russwurm, Ober-Grafendorf (AT)

(73) Assignee: Wittur Holding GmbH, Wiedenzhausen (DE)

( * ) Notice: Subject to any disclaimer, the term of this patent is extended or adjusted under 35 U.S.C. 154(b) by 245 days.

(21) Appl. No.: 17/295,397

(22) PCT Filed: Nov. 19, 2019

(86) PCT No.: PCT/EP2019/081752
§ 371 (c)(1),
(2) Date: May 19, 2021

(87) PCT Pub. No.: WO2020/104428
PCT Pub. Date: May 28, 2020

(65) Prior Publication Data

US 2021/0387831 A1 Dec. 16, 2021

(30) Foreign Application Priority Data

Nov. 19, 2018 (DE) ..... 202018005316.3
Sep. 13, 2019 (DE) ..... 202019105089.6

(51) Int. Cl.
*B66B 5/04* (2006.01)
*B66B 5/20* (2006.01)
*B66B 9/00* (2006.01)

(52) U.S. Cl.
CPC ..... *B66B 5/044* (2013.01); *B66B 5/20* (2013.01); *B66B 9/00* (2013.01)

(58) Field of Classification Search
CPC ..... B66B 5/044; B66B 5/20
See application file for complete search history.

(56) References Cited

U.S. PATENT DOCUMENTS 4,653,612 A * 3/1987 Winkler ..... B66B 5/044 187/350
5,492,200 A * 2/1996 Korhonen ..... B66B 5/044 187/350

(Continued)

FOREIGN PATENT DOCUMENTS

DE 1800270 A 5/1969
DE 3446337 A1 10/1985

(Continued)

*Primary Examiner* — Diem M Tran

(57) ABSTRACT

The invention relates to an overspeed governor for a lifting gear comprising a sheave driven by a overspeed governor cable and a brake for braking the sheave, wherein the brake comprises at least one eccentric piece, mounted on the sheave in a pivoting manner, wherein the eccentric piece is mounted on a first centrifugal weight in a pivoting manner and mounted on a second centrifugal weight in a pivoting manner, wherein, in the event of a displacement of the first and second centrifugal weights due to centrifugal force, the first and the second centrifugal weights pivot the eccentric piece, the brake comprising a reset unit having a spring system which pulls the centrifugal weights in the direction of the undeflected position thereof, wherein the spring system has a first spring constant up to a switching speed, the spring system has a second spring constant from the electric switching speed of the sheave and the second spring constant is greater than the first spring constant.

19 Claims, 21 Drawing Sheets

(56) References Cited

U.S. PATENT DOCUMENTS

Figure 1:
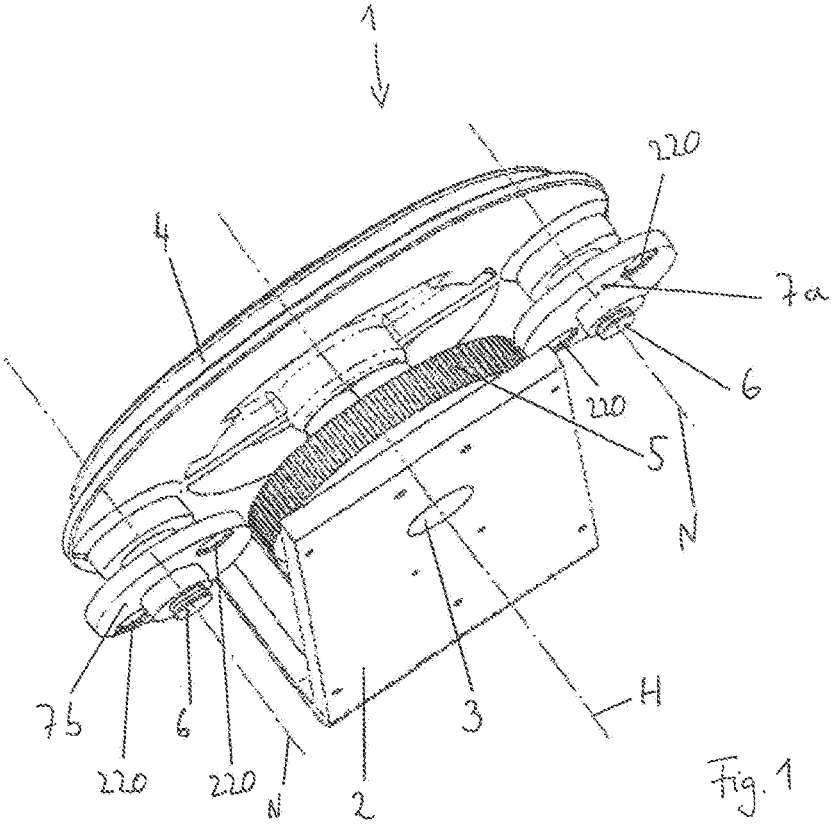

| | | | | |
|---|---|---|---|---|
| 8,950,554 | B2 * | 2/2015 | Niikawa | B66B 5/044 187/305 |
| 2011/0127116 | A1 | 6/2011 | Niikawa | |

FOREIGN PATENT DOCUMENTS

| | | | | |
|---|---|---|---|---|
| DE | 102007052280 | A1 | 5/2009 | |
| DE | 202012103917 | U1 * | 1/2013 | B66B 5/044 |
| EP | 0662445 | A2 * | 7/1995 | |
| JP | 2009154984 | A | 7/2009 | |
| WO | WO-2010046489 | A1 * | 4/2010 | B66B 5/044 |
| WO | 2012086026 | A1 | 6/2012 | |

* cited by examiner

SPEED LIMITER FOR A LIFTING GEAR HAVING BRAKE ACTUATED BY CENTRIFUGAL FORCE

THE TECHNICAL CATEGORY

The invention relates to an overspeed governor according to the generic term of claim 1 as well as to a conveyor with a car guided on guide rails and a corresponding overspeed governor.

THE TECHNICAL BACKGROUND

Such overspeed governors are used in particular in cable and cable-hydraulic lifts to activate a braking and/or catching device as soon as the car moves in an inadmissible manner or at an inadmissible speed. The term "car" is to be interpreted broadly and includes all types of cabins, load carriers, load suspension platforms and the like.

A large number of known overspeed governors are based on the principle of the centrifugally operated brake. This usually involves a sheave and centrifugal weights connected to the sheave, which are in an undeflected position when the sheave is at rest and are driven radially outwards by centrifugal force as the speed increases. A single centrifugal weight is held by a spring, whereby the spring force exerted by the spring counteracts the centrifugal force. On the one hand, the spring serves to return the centrifugal weights to the undeflected position when the speed drops. On the other hand, the spring serves to reduce the travel of the centrifugal weights.

Modern overspeed governors usually detect at least two speeds, both of which are above the nominal speed, i.e. the normal operating speed of the lifting gear. The speeds to be detected are an electrical switching speed and a mechanical switching speed that is greater than the electrical switching speed. The switching speeds are each measured via the deflection of the centrifugal weights, whereby the deflection depends on the spring force and the centrifugal force. When the electrical switching speed is detected, the travel speed of the lifting gear is reduced via electrical means, in particular the drive motor. When the mechanical switching speed is detected, the safety gear of the lifting gear is switched on.

A problem with the known overspeed governors with centrifugally operated brake is that the centrifugal force increases proportionally to the distance of the centrifugal weight from the axis of rotation of the centrifugal weight and quadratically to the increasing rotational speed, so that with conventional overspeed governors the sensitivity of the detection of the switching speed increases. This makes it very difficult to adjust the means for detecting the electrical and mechanical switching speed.

THE TASK UNDERLYING THE INVENTION

It is therefore the task of the invention to create an overspeed governor that can be easily adjusted.

This task is solved with an overspeed governor having the features of claim 1.

Accordingly, an overspeed governor is provided for a lifting gear, in particular a lift installation, which in turn comprises a sheave rotating about a main axis (H) and driven by an overspeed governor rope, and a brake for braking the sheave. The brake comprises at least one eccentric piece pivotably mounted on the sheave and a first centrifugal weight and a second centrifugal weight. The eccentric piece is pivotally mounted on the first centrifugal weight and pivotally mounted on the second centrifugal weight, wherein the first and second centrifugal weights pivot the eccentric piece in response to a centrifugal force-induced displacement of the first and second centrifugal weights. The brake comprises a reset unit with a spring system which pulls the centrifugal weights towards their undeflected position with the spring force provided by the spring system. The spring system has a first spring constant up to (=preferably exactly "up to", in the broader sense in the range up to +25% better only +10% ideally only +7.5% below or above) an electrical switching speed rotational speed (German: "Schaltgeschwindigkeitsdrehzahl") of the sheave and a second spring constant from the electrical switching speed of the sheave. The second spring constant is greater than the first spring constant. In particular, the second spring constant is greater than the first spring constant by a factor of about 1.05, expediently by a factor of about 1.5, particularly expediently by a factor of about 2.

Ideally, the second spring can be preloaded to produce an immediate rise in the characteristic curve with a subsequent flat characteristic curve as soon as the spring is actuated.

In this way, a non-linear and/or discontinuous, in particular linear in sections, spring characteristic curve is achieved, whereby the spring force increases more strongly at greater deflection, in particular from the electrical switching speed, due to the non-linearity and/or discontinuity, compared to a spring characteristic curve in which the spring constant is constant over the entire deflection. As a result, high spring forces also occur at high speeds with high centrifugal forces. Furthermore, by choosing the two spring constants independently, the two trigger points of the overspeed governor can be adjusted more easily independently of each other. In particular, the adjustment of the means for detecting the electrical and the mechanical switching speed is very easy.

The first spring constant is conveniently constant. The second spring constant is conveniently constant. This means that commercially available, inexpensive springs can be used. Furthermore, the adjustment of the means for the detection of the electrical and the mechanical switching speed is very easy with a constant spring constant.

FURTHER EMBODIMENTS OF THE INVENTION

Advantageously, the spring system comprises a first spring with the first spring constant and a second spring, whereby the second spring constant results from an interaction, in particular from addition, of the spring constants of the first and the second spring. It is expedient that the second spring does not exert any force on the centrifugal weights until the electrical switching speed is reached. Due to the two independent springs, the trigger points for the electrical and the mechanical switching speed can be adjusted particularly well and easily.

Alternatively, a spring system could be used in which the spring system consists of an individual spring, the individual spring having the first and second spring constants in sections. Expediently, such an individual spring is a coil spring, in particular a tension or compression spring. Such an individual spring may be a conical spring, thus in particular conical. Alternatively, such an individual spring may be designed such that individual spring sections are completely compressed depending on the force applied. By using only an individual spring, the design is simplified and, if necessary, particularly compact.

Preferably, the first spring is designed as a compression spring and is supported at one spring end on the first centrifugal weight, whereby the spring is supported at the other spring end on a spring support, and whereby the spring support is operatively connected to the second centrifugal weight. Thus, the two centrifugal weights are coupled to each other via the spring.

The second spring is expediently a tension spring, wherein the second spring is attached, in particular hooked, to the first centrifugal weight at one spring end, and wherein the second spring is attached, in particular hooked, to the second centrifugal weight at the other spring end.

Advantageously, the second spring is designed as a leg spring, also called a torsion spring, whereby one leg is supported on the eccentric piece and whereby the other leg is supported on one of the two centrifugal weights at the latest from the electrical switching speed rotational speed. In a further design, one leg can be supported on one of the two centrifugal weights, and the other leg supports the eccentric piece at the latest from the electrical switching speed.

Preferably, a stop bolt, ideally an elongated hole, is attached to one of the centrifugal weights, and the stop bolt or the elongated hole serve as a stop for the second spring. Expediently, a certain travelling distance is provided until the stop is contacted by the second spring, in particular a leg of the second spring. In particular, the second spring, especially a leg of the second spring, only touches the stop from the electrical switching speed. This increases the closing force, which acts against the centrifugal force.

The stop bolt is designed as an eccentric bolt. This means that the time at which the leg spring is activated can be easily and precisely adjusted by turning the eccentric bolt.

Advantageously, the second spring is preloaded. This means that when the second spring takes effect, a quasi abrupt increase in the spring characteristic can be generated, which further optimises the dictance savings of the centrifugal weights. In addition, the second spring can be equipped with a comparatively flat spring characteristic, i.e. with a comparatively small spring constant, in particular with a spring constant that is smaller than the spring constant of the first spring, and still in particular be able to apply the required force. As a result, a flat spring characteristic is provided again after the abrupt increase in the spring characteristic induced by the preload of the second spring. This allows the range to be easily adjusted without any particular sensitivity.

Preferably, the second spring is attached to a spring holder adjustably attached to the eccentric piece, whereby in particular the preload of the second spring can be adjusted by adjusting the spring holder. By adjusting the attachment, the preload of the spring can be changed and the system can be easily adjusted.

Expediently, one end of the second spring is movable in an elongated hole up to the electrical switching speed, whereby the elongated hole is arranged in particular in one of the two centrifugal weights. In this case, no force is transmitted by the spring. If the centrifugal weights are moved far enough due to the centrifugal forces, the spring in particular contacts the end of the elongated hole and the spring transmits forces. This makes it easy to ensure that the second spring does not transmit any forces up to the electrical switching speed.

Advantageously, the brake comprises two eccentric pieces pivotably mounted on the sheave, each of the eccentric pieces being pivotably mounted on the first centrifugal weight and pivotably mounted on the second centrifugal weight, the first and second centrifugal weights pivoting the eccentric pieces in the event of a displacement of the first and second centrifugal weights due to centrifugal force, the first spring consisting of two first, in particular identical, individual springs, wherein each of the first individual springs is supported at its one spring end on one of the two centrifugal weights and each of the first individual springs is supported at its other spring end on a spring support, wherein the two first individual springs are operatively connected to one another via the spring support, and wherein the second spring comprises in each case two second, in particular identical, individual springs, in particular identical in construction, each of the second individual springs being supported at one of its spring ends on one of the two centrifugal weights and at its other spring ends on a respective eccentric piece, in particular from at least the electrical switching speed rotational speed.

Preferably the first spring is preloaded. Preferably, the first spring is preloaded to such an extent that the centrifugal weights do not move from the undeflected position due to the centrifugal force until slightly above, in particular about 10%, preferably about 5%, especially preferably about 2%-3% of the nominal speed, i.e. the normal operating speed of the lifting gear. This allows the design to be particularly space-saving. In addition, the means for detecting the electrical switching speed can be adjusted particularly easily.

A conveyor is expediently provided with a car guided on guide rails, a drive system and a braking device cooperating with the guide rails for stopping an impermissible state of movement of the car, as well as an overspeed governor according to any one of claims 1 to 14 for triggering the braking and catching device.

Further advantages, modes of operation and possible embodiments of the invention can be seen in the examples of embodiments described below with reference to the figures.

FIGURE LIST

Showing:

FIG. 1: Schematic view of a partially assembled overspeed governor as an overview illustration, FIG. 2: A front view of the partially assembled overspeed governor with sheave in a first embodiment with centrifugal weights in an undeflected position, FIG. 2*a*: An enlarged section of FIG. 2

Figure 3:
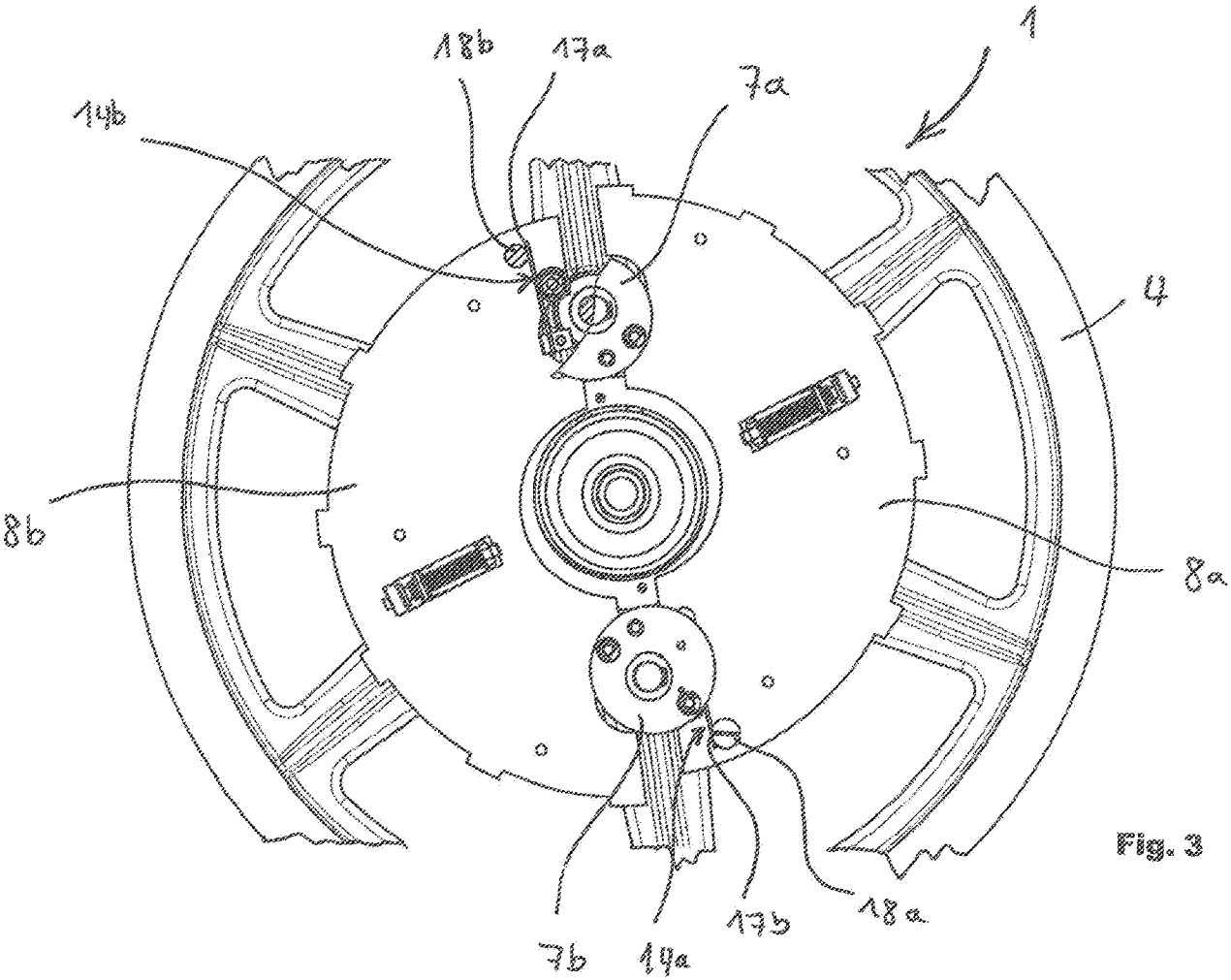
Figure 4:
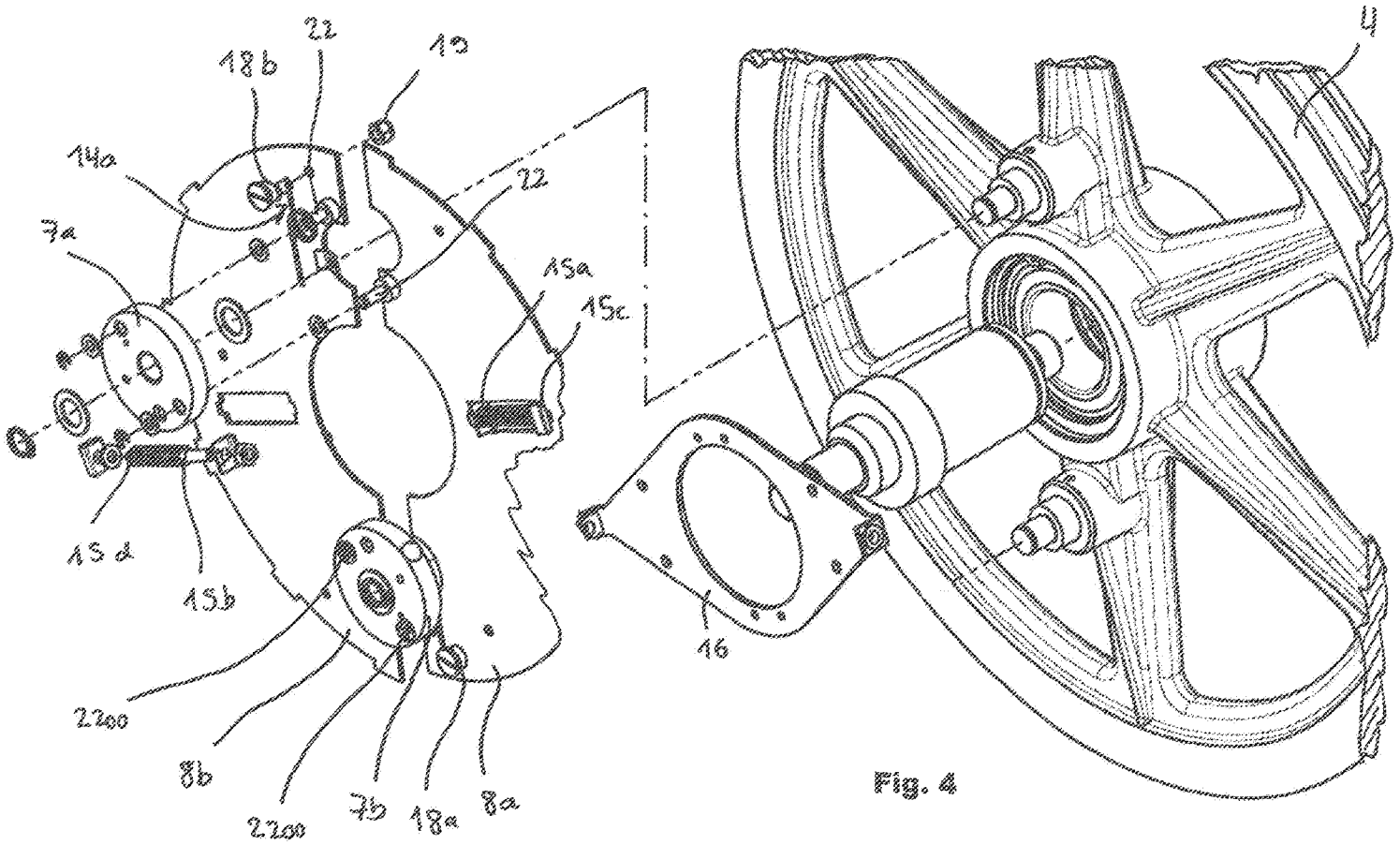
Figure 13:
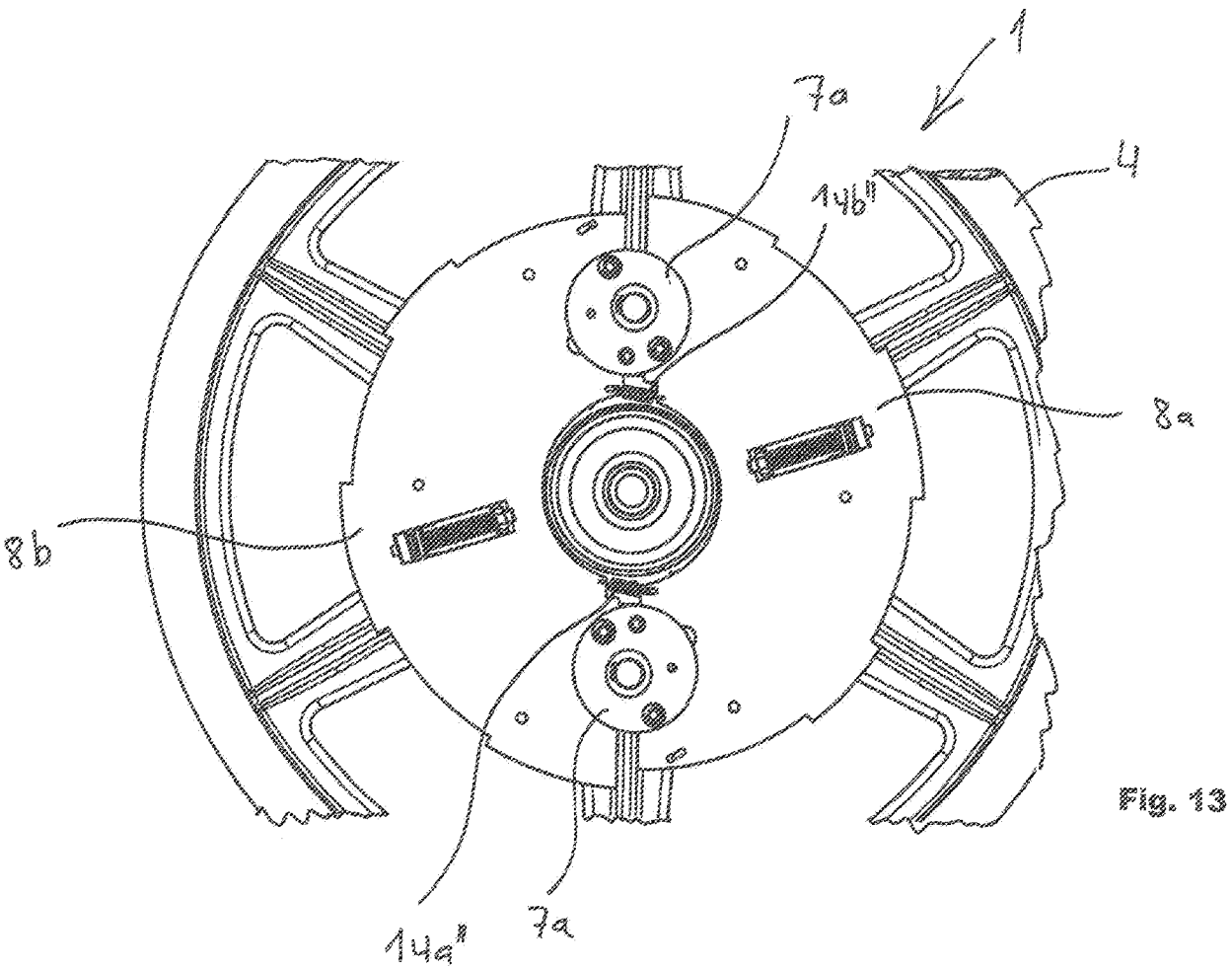
Figure 14:
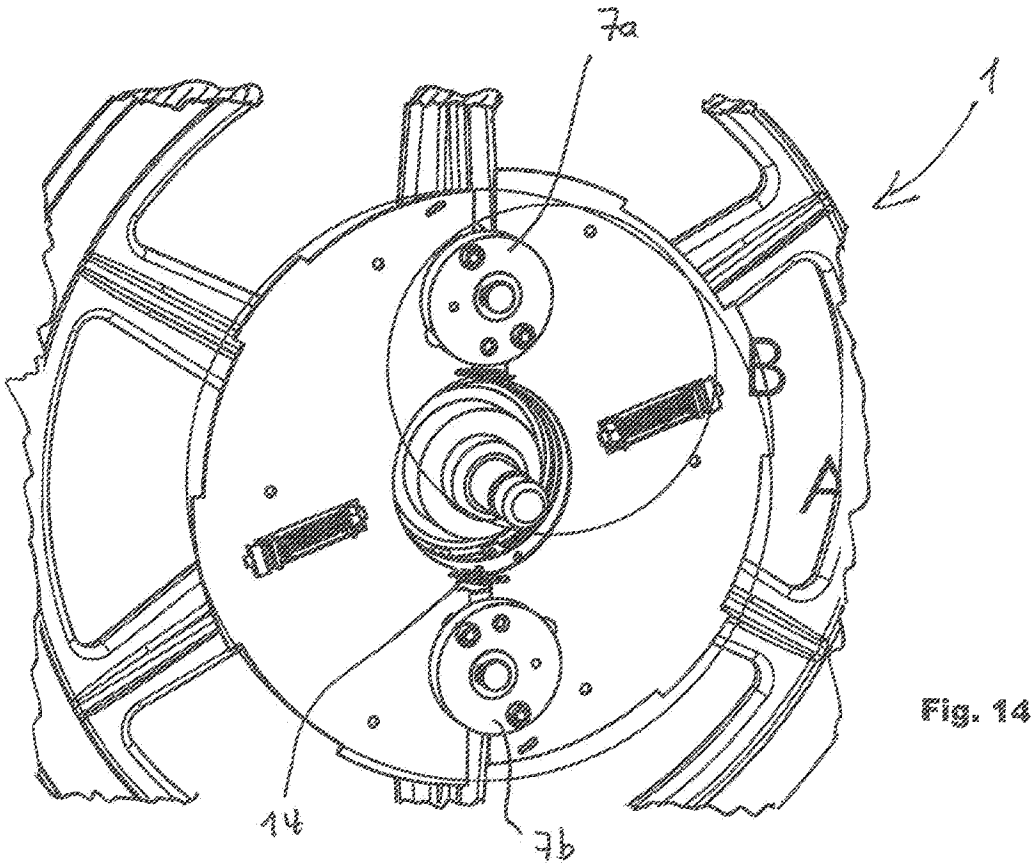
Figure 15:
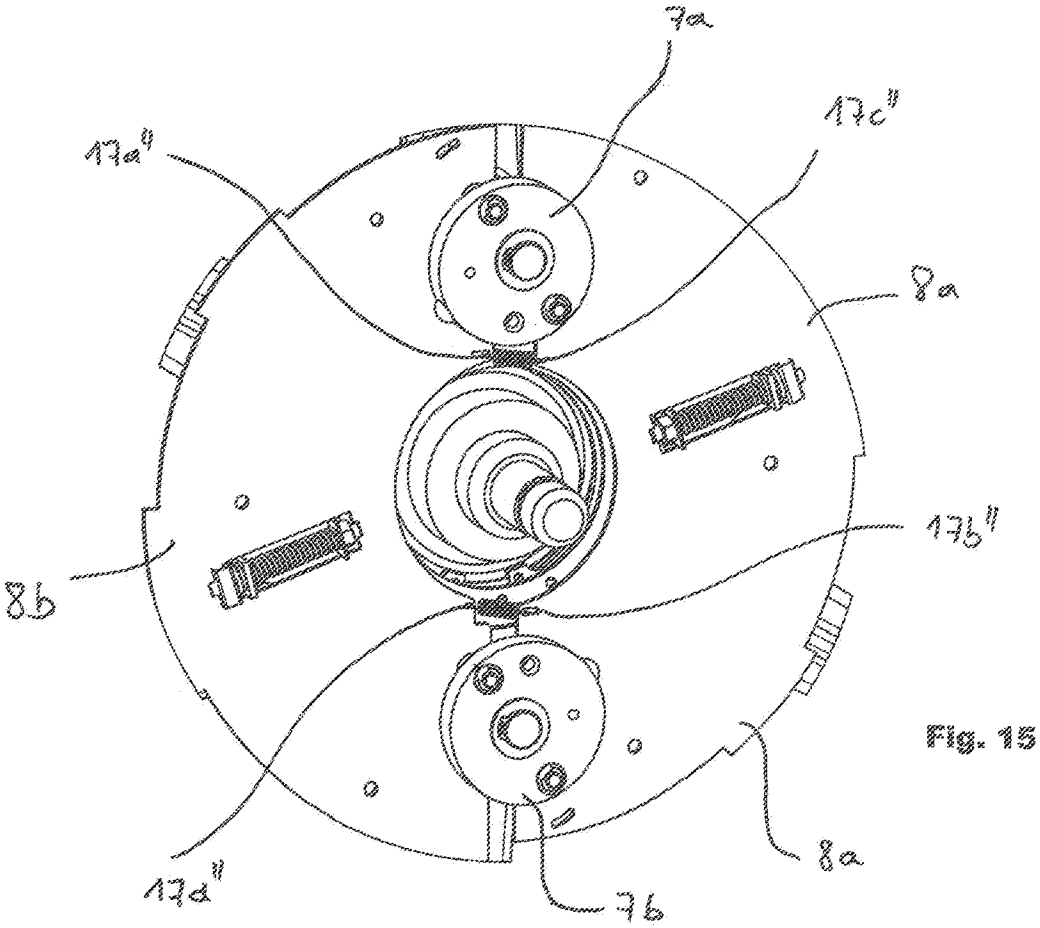
Figure 16:
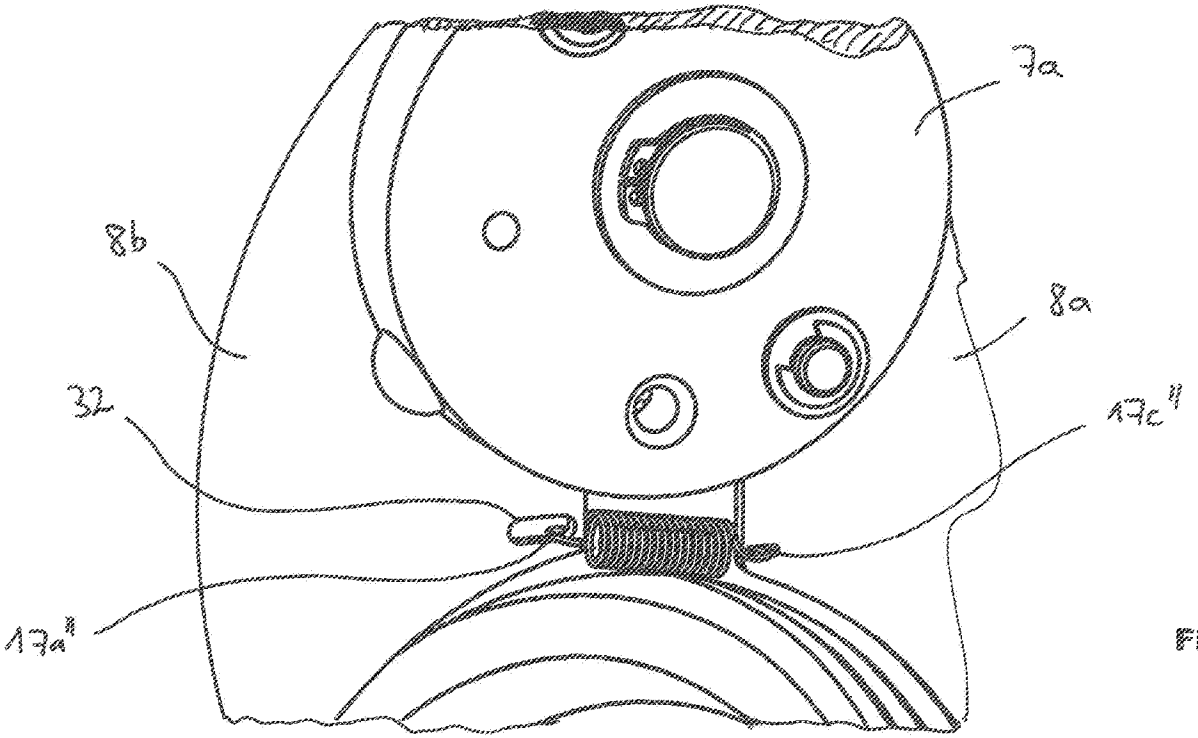
Figure 11:
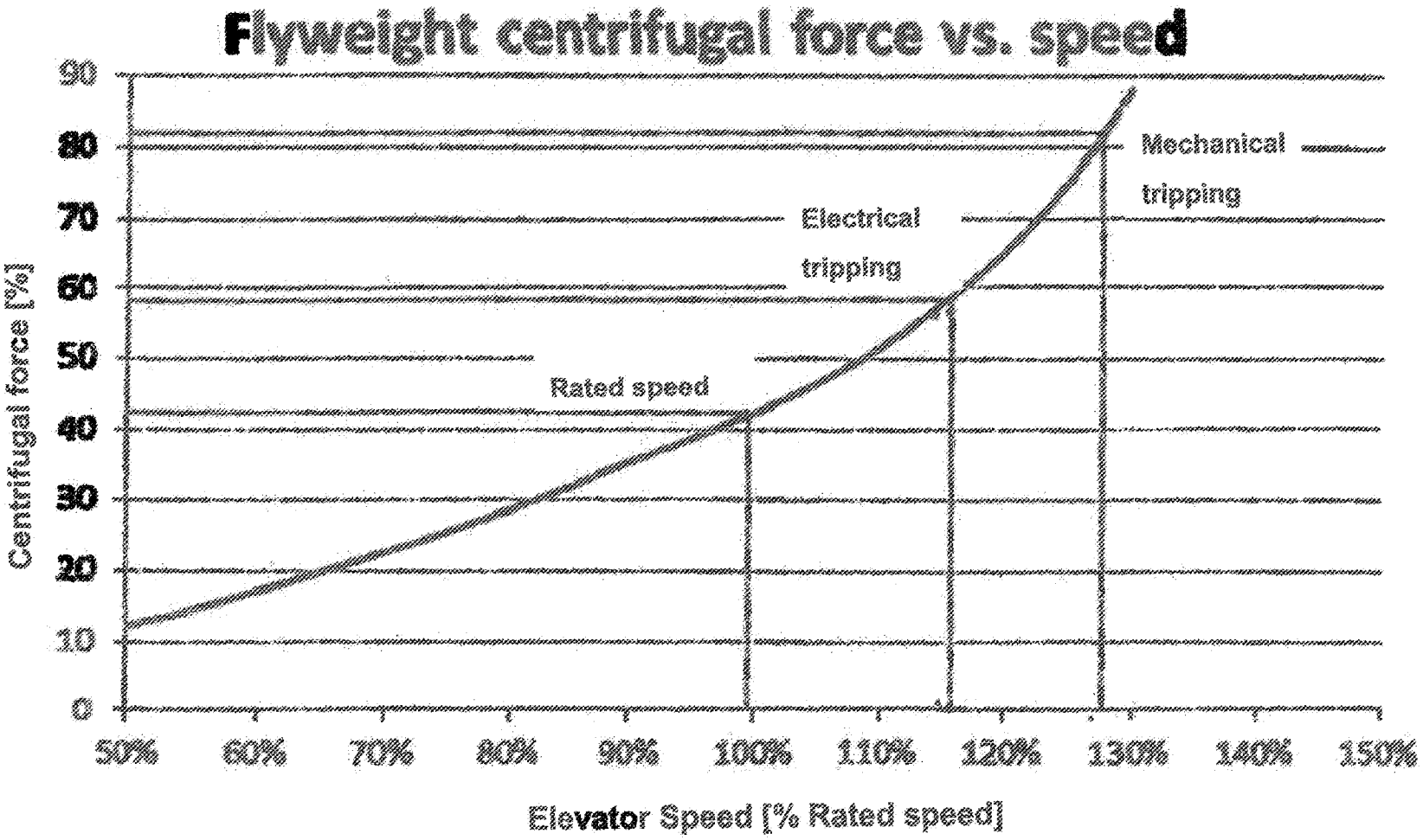

FIG. 3: a front view of the partially assembled overspeed governor in the first embodiment, with the sheave rotating at an electrical switching speed, FIG. 4: An exploded view of the partially assembled overspeed governor in the first embodiment, FIG. 5: a schematic view of an assembled overspeed governor, FIG. 6: A front view of the partially assembled overspeed governor with sheave in a second embodiment with centrifugal weights in an undeflected position, FIG. 7: A perspective view of the partially assembled overspeed governor with sheave in a second embodiment with centrifugal weights in an undeflected position, FIG. 8: a front view of the partially assembled overspeed governor in the second embodiment, with the sheave rotating at the electrical switching speed, FIG. 9: a front view of the partially assembled overspeed governor in the second embodiment, with the sheave rotating at a mechanical switching speed, FIG. 10: a detailed view in the area of an eccentric piece, whereby the sheave rotates at a mechanical switching speed, FIG. 11: a detailed view in the area of an eccentric piece, whereby the sheave does not rotate, FIG. 12: an exploded view of details in the area of the eccentric piece, FIG. 13: a front view of the partially assembled overspeed governor with sheave in a third embodiment, where the sheave rotates at the electrical switching speed, FIG. 14: A perspective view of the partially assembled overspeed governor in the third embodiment, with the sheave rotating at the electrical switching speed, FIG. 15: A detailed view in the area of centrifugal weights, with the sheave rotating at the electrical switching speed, FIG. 16: a detailed view in the area of the eccentric piece, with the sheave rotating at the electrical switching speed, FIG. 17: A schematic diagram illustrating the centrifugal force on the centrifugal weight above a lift speed, FIG. 18: a schematic diagram illustrating a spring characteristic with a spring constant and preloaded first spring, FIG. 19: A schematic diagram illustrating a spring characteristic with different spring constants in sections and a preloaded first spring, FIG. 20: A schematic diagram illustrating a spring characteristic with different spring constants in sections and preloaded first and second springs.

THE PREFERRED EMBODIMENTS

First Example of an Embodiment

FIG. 1 shows a part of an overspeed governor 1. The overspeed governor 1 is preferably designed for vertical lifts for the transport of persons and/or goods not shown in the figures, but can, if necessary, be used for other, similar lifting gears or conveyor systems whose travel movement requires permanent monitoring for the detection of impermissible travel conditions.

Ideally, although not necessarily, the basic concept of the overspeed governor 1 is the same as that of the overspeed governor already known from the earlier patent application DE 10 2007 052 280 of the same applicant. The said patent application is made part of the present description by reference in its entirety, so that the basic function and the fundamental structure of the overspeed governor described here as a preferred embodiment need not be recounted. The right is reserved to adopt delimitation features from the already existing application text.

The overspeed governor 1 has a supporting structure 2, which here consists of an L-shaped steel plate. A cantilevered axle stub 3 is attached to this steel plate.

The axle stub 3 defines the main axis H of the overspeed governor 1. The rope sheave 4 for a overspeed governor rope not shown in the figures is rotatably mounted on this axle stub 3.

Next to the sheave 4, a brake rotor 5 is mounted on the axle stub 3. Although this brake rotor 5 has a disc-shaped form, it still acts in the manner of a drum brake in this case, as its circumferential surface is the friction surface.

The sheave 4 is provided with bearing bolts 6 on its one end face. These bearing bolts 6 each form a secondary axis N, typically arranged parallel to the main axis H. An eccentric piece 7*a* or 7*b* is rotatably mounted on each of them. An eccentric piece 7*a*, 7*b* can also be considered to be an eccentric disc, an intermediate piece, or the like. Each of these eccentric pieces 7*a*, 7*b*—if necessary equipped accordingly, which is not shown here—functionally forms a brake shoe. If the respective eccentric piece 7*a*, 7*b* rotates far enough, it comes into braking contact with the brake rotor 5. In most cases, the design (not shown here) is such that the braking effect itself is reinforced as soon as the eccentric piece 7*a*, 7*b* has come into initial frictional contact with the brake rotor due to the sufficiently far rotation. In order to achieve transverse force compensation, at least two eccentric pieces 7*a*, 7*b*, which are as diametrically opposed as possible, are expediently provided. Modified designs with three, four or more eccentric pieces 7*a*, 7*b* are conceivable, but are not shown here.

Each of the eccentric pieces 7*a*, 7*b* is in turn provided with two coupling bolts 2200, FIG. 4. Coupling bolt bores 220 are provided in the eccentric pieces 7*a*, 7*b* for the coupling bolts 2200, cf. FIG. 1. Via one of its coupling bolts 2200 the respective eccentric disc 7*a*, 7*b* is connected to a first centrifugal weight 8*a* shown in FIG. 2. The eccentric disc 7*a*, 7*b* in question is connected to a second centrifugal weight 8*b* via the other of its coupling bolt 2200. This can be seen clearly in FIG. 2.

From the point of view of patent law, it should be noted that the terms "first eccentric piece" and "second eccentric piece" as well as "first centrifugal weight" and "second centrifugal weight" etc. do not initially represent a numerical restriction. However, the use of only two eccentric pieces, two centrifugal weights etc. is a preferred embodiment, as it keeps the component expenditure small. If necessary, it may be expedient to provide only one centrifugal weight 8*a*, 8*b* and/or only one eccentric piece 7*a*, 7*b*. If necessary, it may be appropriate to provide more than two centrifugal weights 8*a*, 8*b* and/or more than two eccentric pieces 7*a*, 7*b*.

The two centrifugal weights 8*a* and 8*b* are designed as half-discs in this embodiment. In certain cases, the intrinsic mass of these half-discs, which are preferably made of sheet metal, is sufficient to develop sufficient centrifugal forces at the speeds at which the response is intended to take place. In other cases, these half-discs can be provided with additional weights.

Neither of the two centrifugal weights 8*a*, 8*b* is itself mounted directly opposite the main axis H or on the axle stub 3. Instead, the centrifugal weights are held in position exclusively with the help of the eccentric discs 7*a* and 7*b*, to which they are coupled via the coupling bolts 2200, and with the help of the reset unit 10, which will be described in more detail later—in such a way that the centrifugal weights 8*a* and 8*b* can shift in a radially outward direction at a sufficiently high speed.

In view of FIG. 2, it is easy to understand that the centrifugal weights 8*a*, 8*b* move radially outwards in opposite directions (in the direction of the arrows VR) as soon as the centrifugal force acting on each of them is great enough to overcome the spring force, to be explained in more detail later, which holds the centrifugal weights 8*a*, 8*b* in their undeflected position 9.

This creates a torque on the eccentric discs 7*a* and 7*b*, which twists the eccentric discs or the brake lining carried by them, which is not shown again here, in such a way that it comes into contact with the brake rotor 5 shown in FIG. 1 and, as a rule, blockage then occurs due to the self-reinforcement effect already mentioned. As a result, the sheave 4 is braked. There is tension on the overspeed governor rope. This can now trigger the braking or catching gear attached to it.

Figure 2:
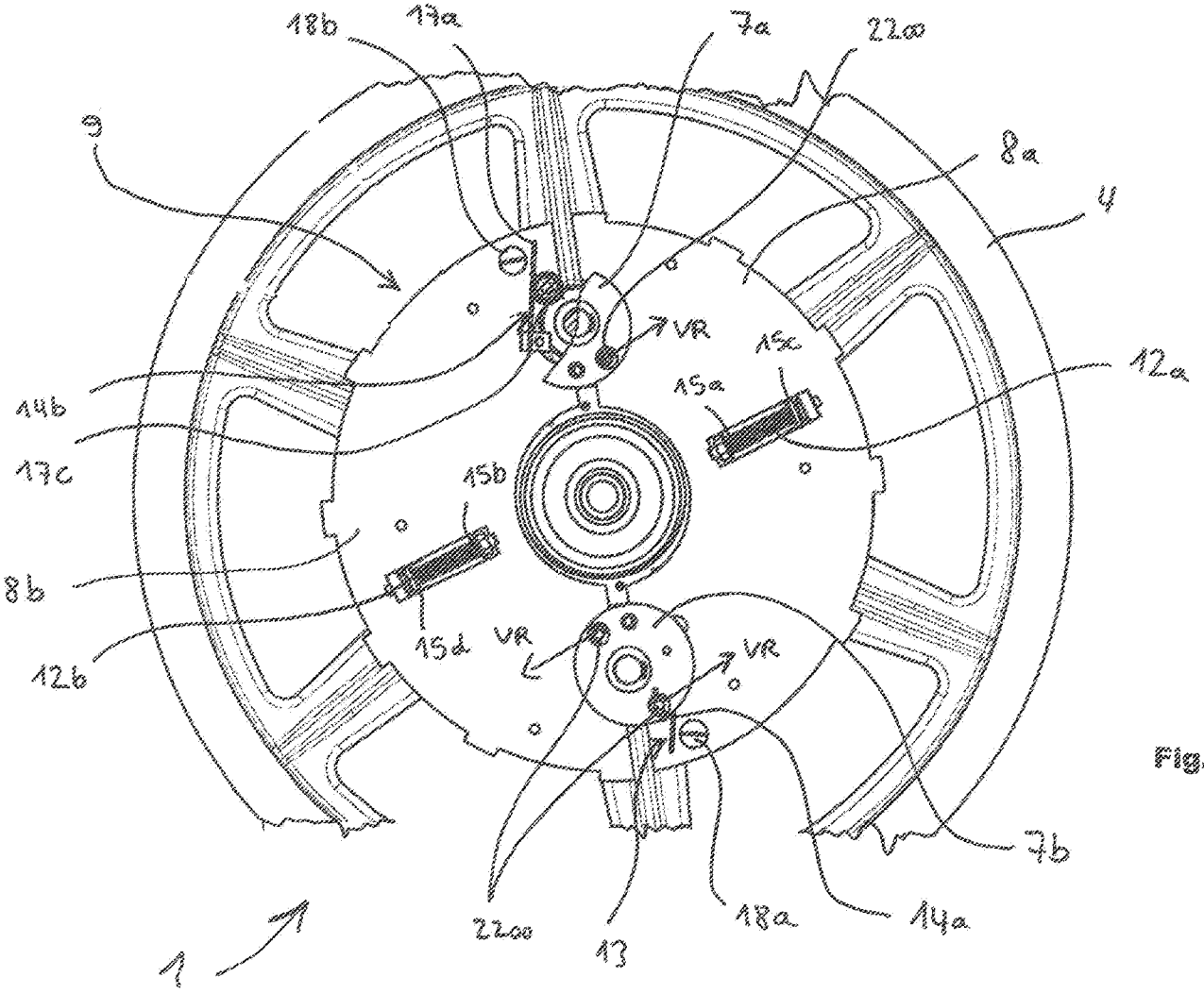
Figure 2A:
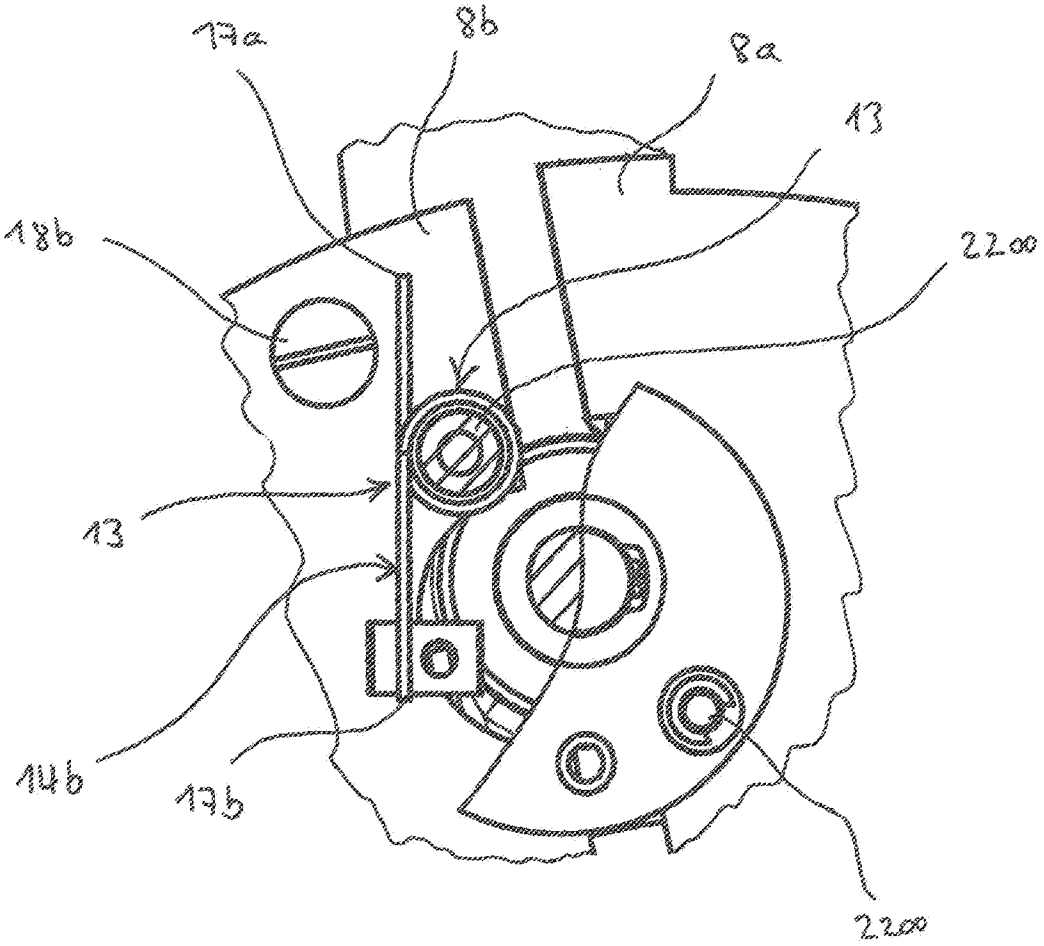

It is important to realize that the centrifugal weights 8*a* and 8*b* shown in FIG. 2 not only move outwards in a purely radial direction, but are also subject to a certain transverse movement, since the rotation of the eccentric discs 7*a*, 7*b* changes the position of the coupling bolts 22 holding the centrifugal weights with respect to the main axis H. Each of the two centrifugal weights 8*a* or 8*b* therefore also shifts a little in the transverse direction in the course of its displacement in the radially outward direction. This is also the reason why the two centrifugal weights 8*a* or 8*b* are not themselves mounted directly opposite the main axis H.

Of particular interest to the invention is the reset unit 10. The reset unit 10 is best described with reference to FIG. 2, FIG. 3 and FIG. 4. The reset unit 10 comprises a spring system which pulls the centrifugal weights 8*a*, 8*b* towards their undeflected position 9 with the spring force provided by the spring system.

The spring system comprises a first spring. In the embodiment example according to FIG. 2, the first spring preferably consists of two (or more) first individual springs 12*a*, 12*b*. The two first individual springs 12*a*, 12*b* are of identical construction. In the embodiment example, the two first individual springs 12*a*, 12*b* are designed as coil springs.

The first of the two first individual springs 12*a* is supported at one spring end 15*a* on the first centrifugal weight 8*a*. At its other spring end 15*c*, the first of the first two individual springs 12*a* is supported by a spring support 16 shown in FIG. 4. The second of the first two individual springs 12*b* is supported at its one spring end 15*b* on the second centrifugal weight 8*b*. The second of the first two individual springs 12*b* is supported at its other spring end 15*d* on the spring support 16. The first two individual springs 12*a*, 12*b* are thus operatively connected to each other via the spring support 16.

The spring system comprises a second spring shown in FIG. 2. In the embodiment example according to FIG. 2, the second spring consists of two second individual springs 14*a*, 14*b*. The two second individual springs 14*a*, 14*b* are of identical construction. In the embodiment example, the two second individual springs 14*a*, 14*b* are designed as leg springs, also called torsion springs.

A stop bolt in the form of an eccentric bolt 18*a*, 18*b* is attached to each of the two centrifugal weights 8*a*, 8*b*. The stop bolts in the form of the eccentric bolts 18*a*, 18*b* serve as a stop for the second spring in the form of the two second individual springs 14, 14*b*. The first of the two second individual springs 14*a* can be supported at its one spring end 17*a*, or at one of its legs, on the second eccentric bolt 18*b*. At its other spring end 17*c*, or at its other leg, the first of the two second individual springs 14*a* is supported on the first eccentric piece 7*a*. The second of the two second individual springs 14*b* can be supported at its one spring end 17*b*, or at its one leg, on the first eccentric bolt 18*a*. The second of the two second individual springs 14*b* is supported at its other spring end 17*d*, or its other leg, on the second eccentric piece 7*a*.

In the undeflected position 9 of the centrifugal weights 8*a*, 8*b* shown in FIG. 2, the one spring ends 17*a*, 17*c* of the second individual springs 14*a*, 14*b* are not supported on the eccentric bolts 18*a*, 18*b*, i.e. they are not yet spring-activated.

If the sheave 4 and thus the two centrifugal weights 8*a*, 8*b* start to rotate at a speed lower than the first electrical switching speed, the centrifugal force emanating from the rotation and the mass of the centrifugal weights 8*a*, 8*b* presses on the first spring in the form of the two first individual springs 12*a*, 12*b*, the centrifugal force being compensated for in the state of equilibrium via the spring force of the first spring, which is generated by means of the first individual springs 12*a*, 12*b* and via the spring support 16. Preferably up to the first electrical switching speed or beyond, the spring system has a first spring constant D1, wherein the spring constant D1 in this embodiment example is composed additively of the two spring constants of the two first individual springs 12*a*, 12*b*.

If the rotational speed of the sheave 4 is increased up to or beyond a first electrical switching speed, the eccentric pieces 7*a*, 7*b* including the second individual springs 14*a*, 14*b* attached to the eccentric pieces 7*a*, 7*b* are pivoted until the spring ends 17*a*, 17*b* of the two second individual springs 14*a*, 14*b* rest against the eccentric bolts 18*a*, 18*b*. At a speed greater than or equal to the first electrical switching speed, the centrifugal force resulting from the rotation and the mass of the centrifugal weights 8*a*, 8*b* presses on the first spring in the form of the two first individual springs 12*a*, 12*b*, whereby the centrifugal force is generated via the spring force of the first spring, via the first individual springs 12*a*, 12*b* and via the spring support 16, and on the second spring in the form of the two second individual springs 14*a*, 14*b*, whereby it is compensated in the state of equilibrium. From or above the first electrical switching speed, the spring system therefore has a second spring constant D2, whereby the spring constant D2 in this embodiment example is composed additively of the two spring constants of the two first individual springs 12*a*, 12*b* and the two second individual springs 14*a*, 14*b*.

In the embodiment example, all spring constants of the individual springs 12*a*, 12*b*, 14*a*, 14*b* and thus also the first spring constant of the first spring and the second spring constant of the second spring are constant.

FIG. 4 clearly shows that the eccentric bolt 18*a* is attached to the second centrifugal weight 8*b* in the form of a screw connection with a retaining or lock nut 19. Similarly, the other eccentric bolt 18*b* is attached to the first centrifugal weight 8*a* in the form of a screw connection with such a nut, which is not shown. The eccentric bolt 18*a*, 18*b* has a slot (single or cross slot or star) on the head side. This is provided for the application of a screwdriver. The head of the eccentric bolt 18*a*, 18*b* rotates eccentrically. This makes it easy to adjust the relative distance between the eccentric bolt and the end of the respective second individual spring 14*a*, 14*b*. This sets the speed at which the second springs in the form of the second individual springs 14*a*, 14*b* are in contact with the eccentric bolt 18*a*, 18*b*, thus increasing the spring constant in the overall system.

Figure 5:
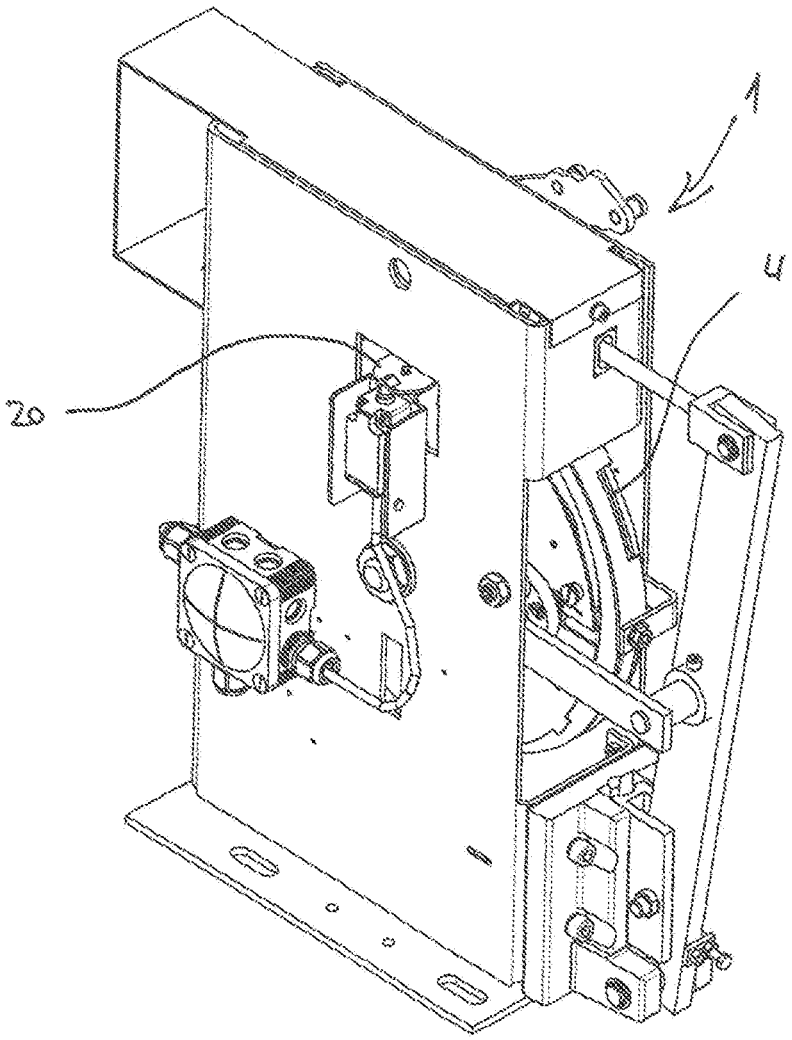

FIG. 5 shows the assembly of the complete overspeed governor 1. A means 20, in the form of a switch, is attached to the overspeed governor 1. The switch is then switched when the sheave 4 exceeds a predetermined speed, in particular the electrical switching speed. An electrical signal is then sent to an electronic control unit, not shown in the figures, for controlling the lifting gear, whereby the electric motor is throttled, for example, so that the speed of the lifting gear is reduced.

If the speed of the lifting gear is increased even further to the mechanical switching speed, the sheave 4 is braked by the brake and the rope running around the sheave and connected to the cabin triggers a mechanical braking.

Second Example of an Embodiment

FIGS. 6 to 12 show the overspeed governor 1' in a second embodiment.

The overspeed governor 1' in the second embodiment is essentially the same as the overspeed governor 1 in the first embodiment, so that what has been said above about the overspeed governor 1 according to the first embodiment also applies to the overspeed governor 1" according to the second embodiment, with the exception of the changes made in the second embodiment. In particular, the same reference signs designate the same components.

The essential difference of the overspeed governor 1' according to the second embodiment example compared to the overspeed governor 1 according to the first embodiment example is that the second spring 13' is adjustable differently, more advantageously, namely mostly more sensitively, or in a wider range.

The construction for generating the pre-load of the second spring 13' is explained below with reference to FIGS. 10 to 12 and with reference to the second individual spring 14*a*', which is arranged on the first eccentric piece 7*a*. Corresponding statements made here can be transferred to the other second individual spring 14*b*', which is arranged on the second eccentric piece 7*b*.

A spring holder 22 is arranged on the first eccentric piece 7*a*. For maintenance and adjustment, the spring holder 22 is adjustable relative to the eccentric piece 7*a*, for example swivelling, by means of the adjusting screw VS, cf. FIG. 10. During operation of the lifting gear, the spring holder 22 is firmly connected to the eccentric piece 7*a*.

In the embodiment example, the spring holder 22 is made or bent, preferably from a sheet of metal. The spring holder 22 comprises a base surface 25. A particularly circular aperture 26 is punched into the base surface 25, cf. FIG. 12. In the installed state, aperture 26 encloses the coupling bolt 2200. The base surface 25 rests against a stop on the coupling bolt 2200 and is thus fixed in the axial direction, i.e. direction parallel to the main axis H (FIG. 1). A first end surface 27 adjoins the base surface 22. The first end surface 27 is at about 90° to the base surface. A receiving groove 24 is arranged in the first end surface 27. The receiving groove 24 is open towards the lower end of the end surface 27. In another embodiment, the receiving groove 24 can also be a bore, an elongated hole, or the like.

Figure 11:
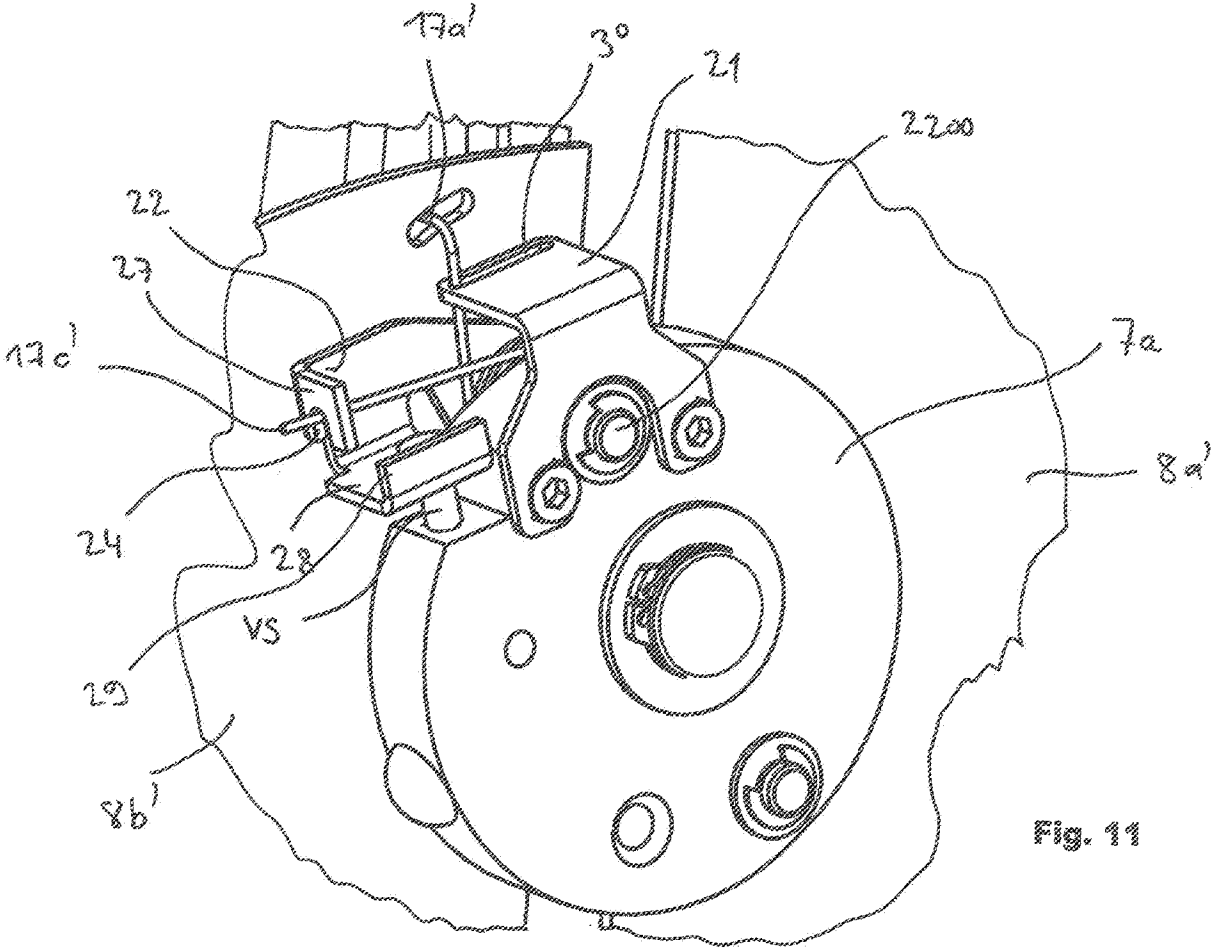

In the operational state, the spring end 17*c*, in particular the leg, of the second individual spring 14*a*' lies in the receiving groove 24, cf. in particular FIG. 11.

Figure 12:
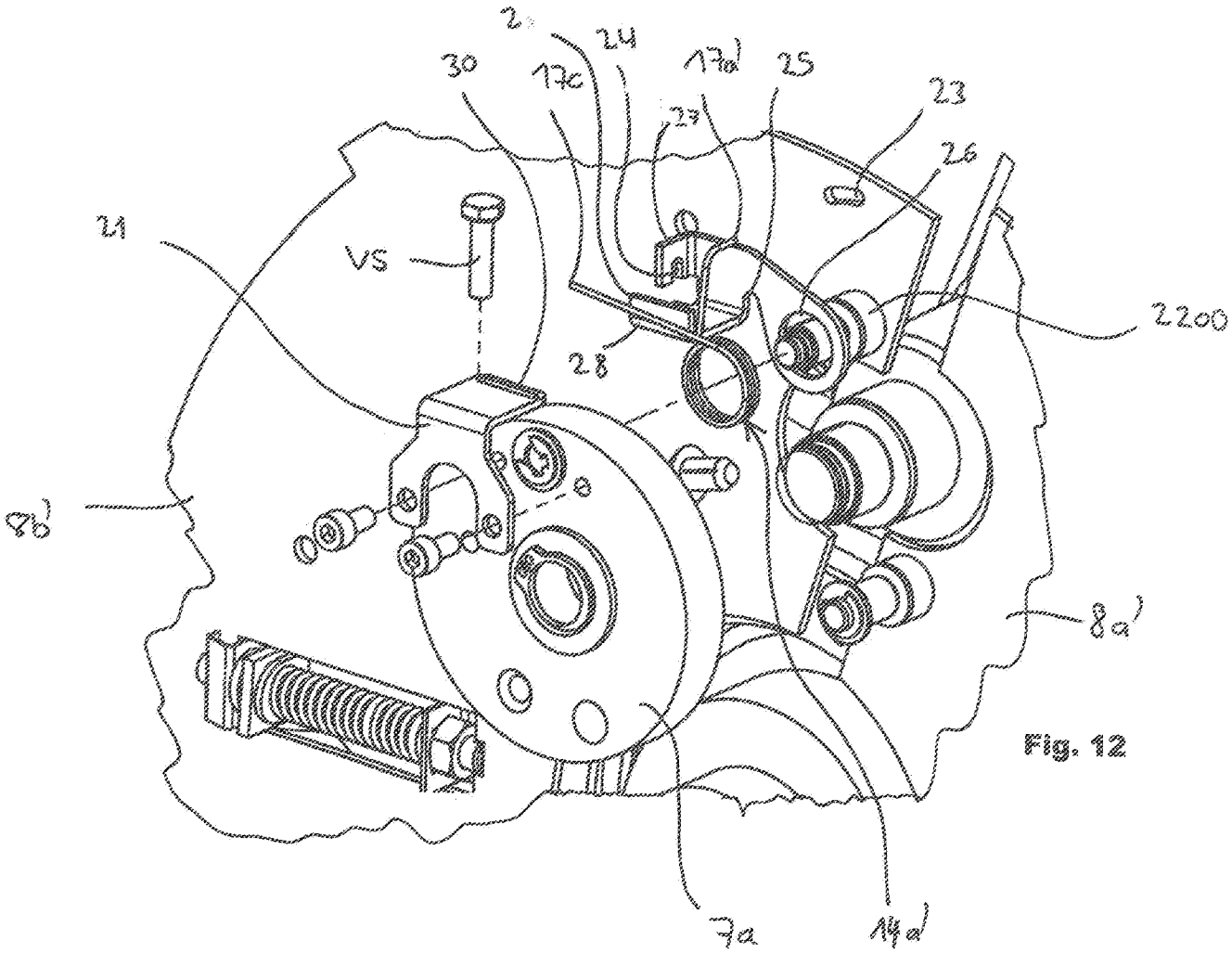

As shown in FIG. 12, the spring holder 22 comprises a second end surface 28. The second end surface 28 is approximately orthogonal to the base surface 25 and approximately orthogonal to the first end surface 27. One edge of the second end surface 28 forms a stop 29. The stop 29 strikes the initial portion of the spring end 17*a*', in particular the initial portion of the leg, of the second individual spring 14*a*' in the operational state. The stop 29 has a distance to the axis of rotational symmetry of the coupling bolt 2200. The distance of the stop 29 to the axis of rotational symmetry of the coupling bolt 2200 can be changed during maintenance, for example with the said set screw VS, which can also be seen in FIG. 12, but—contrary to what the exploded view seems to suggest—is not inserted through the guide plate 21, which will be explained in more detail in a moment, but is screwed in below it so that it supports or positions the second end surface 28. By changing the distance, the preload of the second spring changes. In particular, the preload is increased when the distance is reduced.

As can be clearly seen in FIG. 12, the end region of the spring end 17*a*', in particular the initial part of the leg, of the second individual spring 14*a*' is cranked, in particular by about 90° to the initial region of the spring end 17*a*'. In the installed state, the end region of the spring end 17*a*' is inserted in an elongated hole 23 arranged in the first centrifugal weight 8*a*'. A guide plate 21 is provided to secure the spring end 17*a*' so that it does not accidentally slip out of the elongated hole 23 during operation. The guide plate 21 is fixed, in particular screwed, to the eccentric piece 7*a*. The guide plate 21 has a guide groove 30. The guide groove 30 runs approximately parallel to the spring end 17*c* of the second individual spring 14*a*' and approximately orthogonal to the other spring end 17*a* of the second individual spring 14*a*'.

Figure 6:
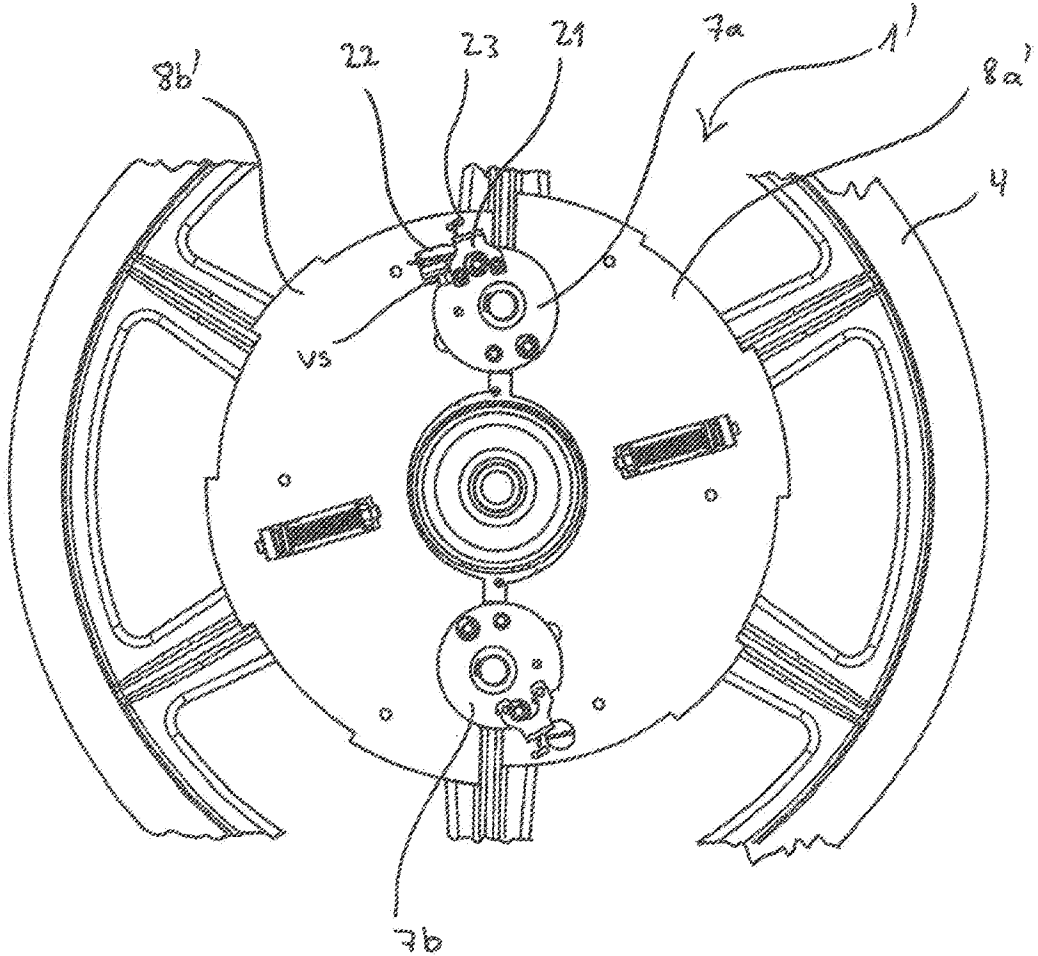
Figure 7:
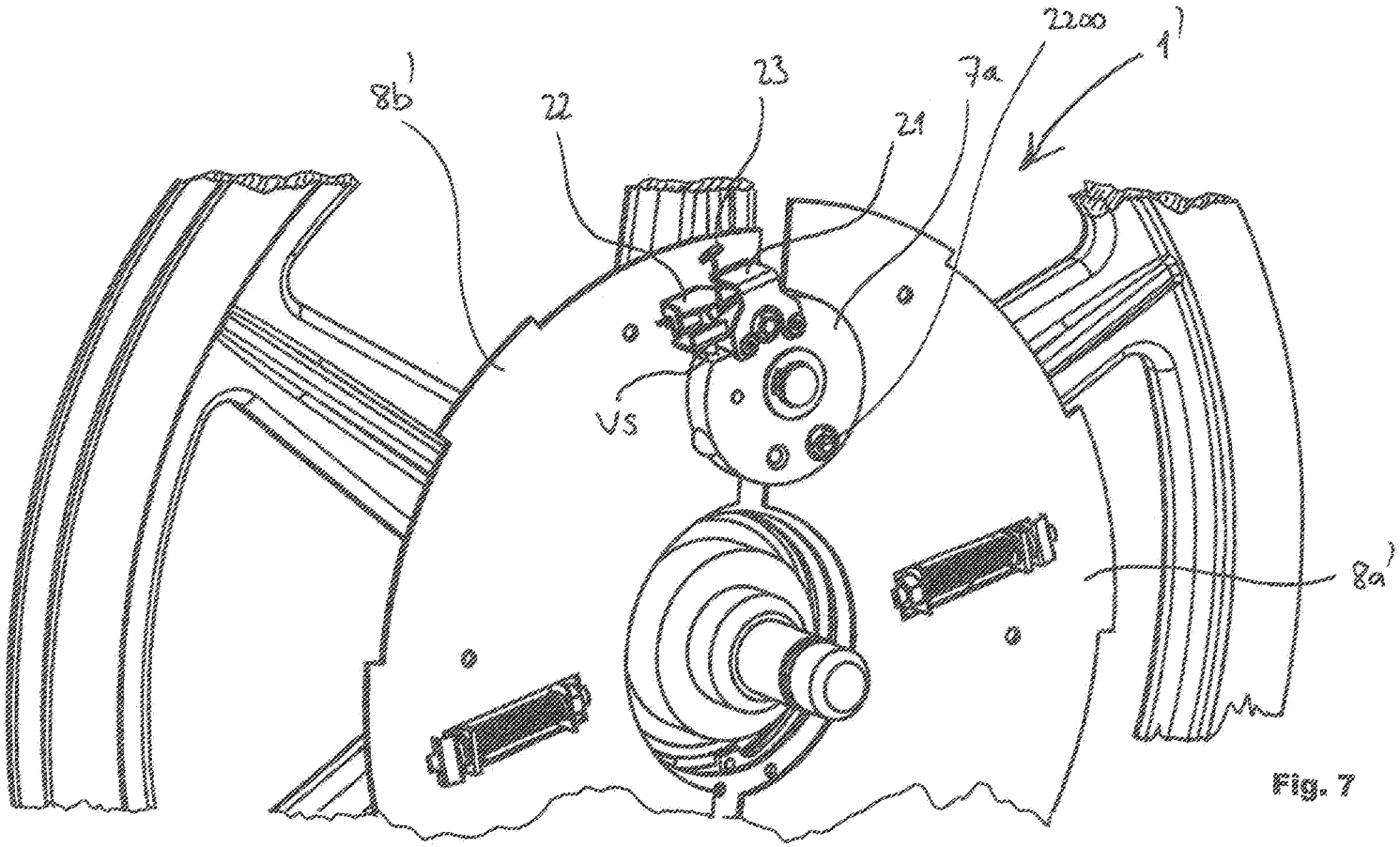

The elongated hole 23 is optionally (particularly preferably) provided so that the second spring 13', in particular the second individual spring 14*a*', does not bear against the centrifugal weight 8*b* in the operating state below the electrical switching speed, as shown in FIGS. 6, 7 and 11, in the sense that the second spring 13' does not transmit any spring force to the brake and thus in particular does not additionally contribute to the spring constant D1.

Figure 8:
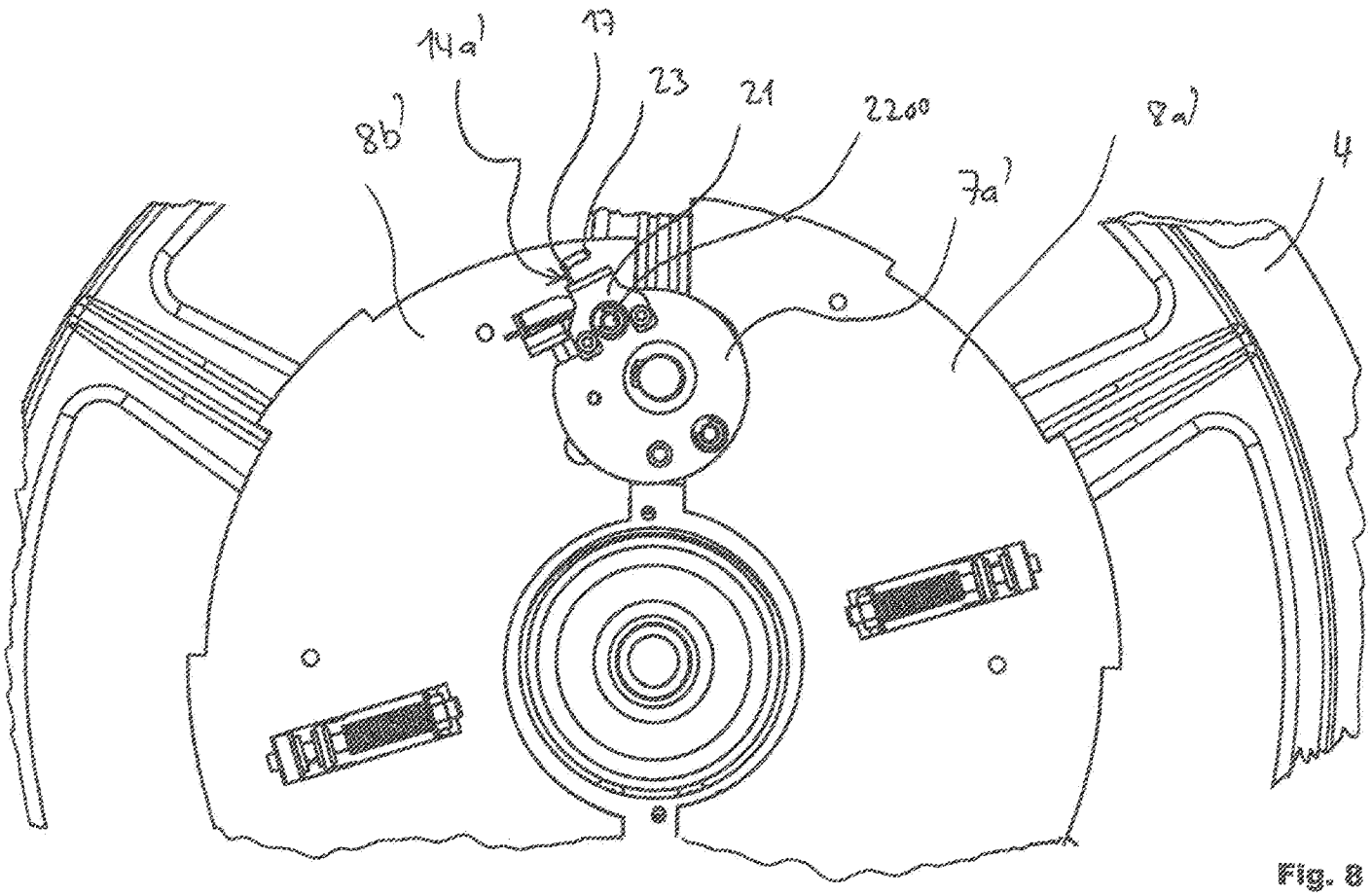
Figure 9:
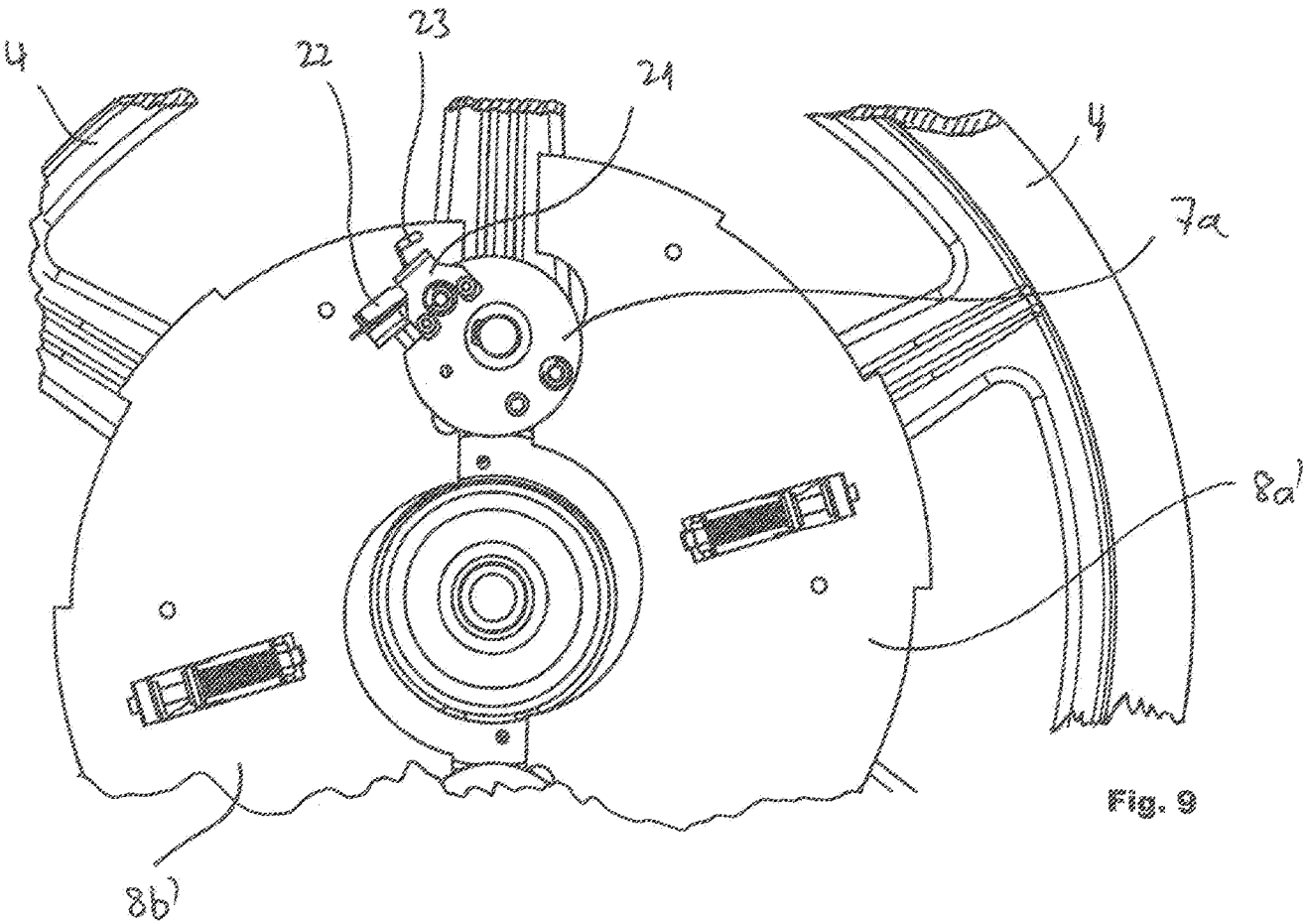
Figure 10:
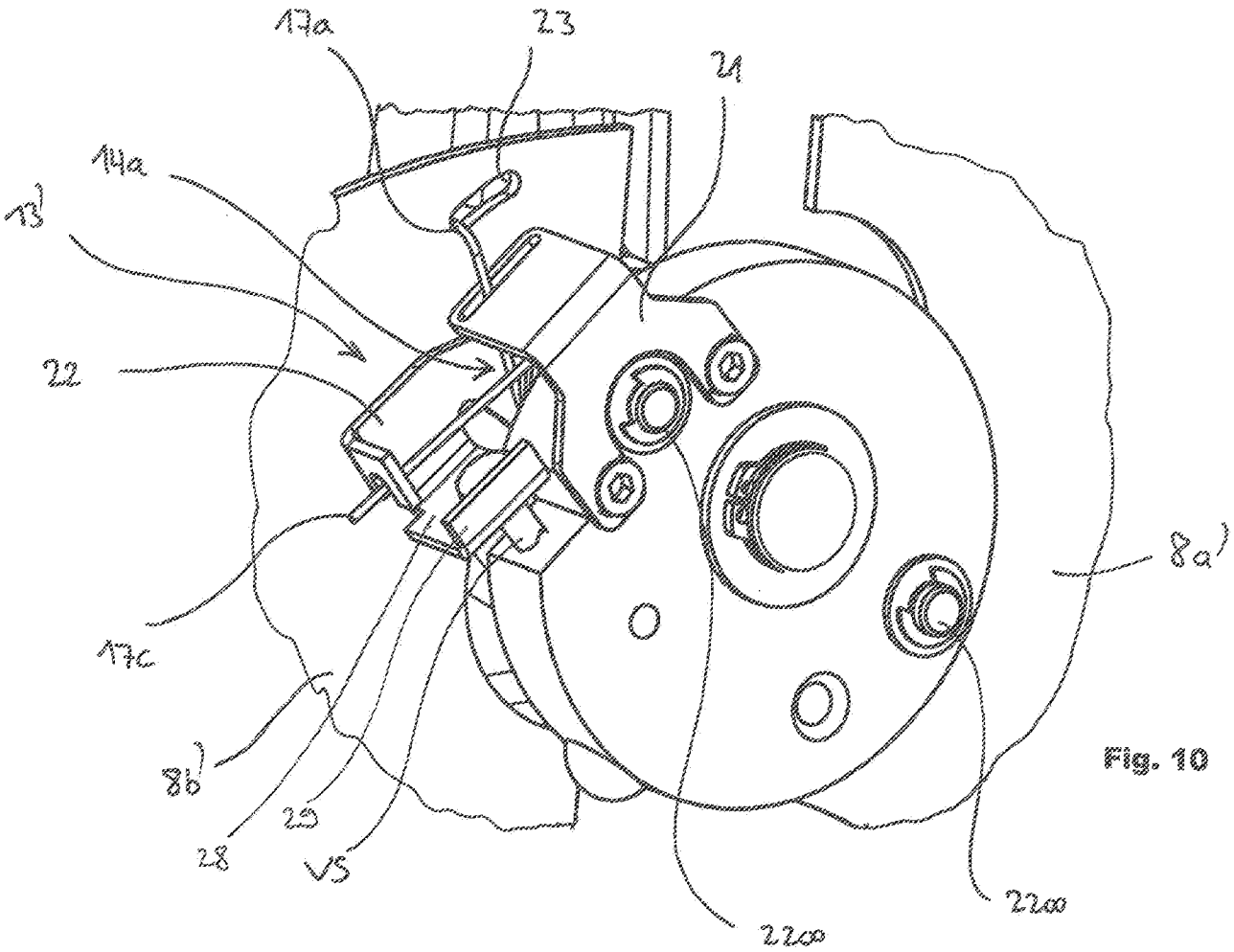

If the speed is increased to electrical switching speed or more, as shown in FIGS. 8, 9 and 10, the second spring 13', in particular the second individual spring 14*a*', is in contact with the centrifugal weight 8*b* via the end of the elongated hole 23 in the sense that the second spring 13' transmits a spring force to the brake and thus in particular additionally contributes to the spring constant D1 and a spring constant D2 is produced. FIG. 8 shows the electrical switching speed, FIG. 9 the mechanical switching speed. It can be seen that the spring constant D2 is present in both the electrical and mechanical switching speed states.

Third Example of an Embodiment

FIGS. 13 to 16 show the overspeed governor 1" in a third embodiment. The overspeed governor 1" in the third embodiment corresponds essentially to the overspeed governor 1 of the first embodiment, so that what has been said above about the overspeed governor 1 according to the first embodiment also applies to the overspeed governor 1" according to the third embodiment, with the exception of the changes made in the second embodiment. In particular, the same reference signs designate the same components.

The essential difference of the overspeed governor 1" according to the third embodiment example compared to the overspeed governor 1 according to the first embodiment example is that the second spring of the overspeed governor 1' according to the third embodiment example acts directly between the first centrifugal weight 8*a* and the second centrifugal weight 8*b*. The second spring in the third embodiment example is formed by at least one helical spring, in particular a tension spring with two end hooks. In the following, the functional principle will be described on the basis of the first of the two second individual springs 14*a*", whereby what has been said applies accordingly to the second of the two second individual springs 14*b*".

The two centrifugal weights 8*a*, 8*b* are each approximately semi-circular in shape, whereby a circular recess for receiving the centrifugal weights is provided in the inner area facing the main axis H (FIG. 1). A bore 31 is provided on the first centrifugal weight 8*a* in the area of the circular recess. The spring end 17*c*" of the second individual spring 14*a*" is suspended in the bore 31. An elongated hole 32 is provided on the second centrifugal weight 8*b* in the area of the circular recess. The spring end 17*a*" of the second individual spring 14*a*" is suspended in the elongated hole 32. Due to the optional elongated hole 32, the spring end 17*a*" of the second individual spring 14*a*" has regular play up to the electrical switching speed, so that the second spring 13", in particular the second individual spring 14*a*", does not transmit any force between the two centrifugal weights 8*a*, 8*b* or does not exert any force. If the speed is increased to at least the electrical switching speed, the spring end 17*a*" of the second individual spring 14*a*" rests against the end of the elongated hole 32 and the second spring 13", in particular the second individual spring 14*a*", transmits spring forces and thus contributes to increasing the spring constants.

It can be useful that the second spring is preloaded from the individual springs 14*a*", 14*b*". In particular, the spring is wound with preload.

The invention comprises a conveyor not shown in the figures, having a car guided on guide rails, a drive system and a braking device cooperating with the guide rails for ending an impermissible state of movement of the car, as well as an overspeed governor 1, 1', 1" as described with respect to the figures.

Basic Notes on the Operating Principle of all Embodiments

FIGS. 17 to 20 provide a theoretical explanation of the functional principle.

Figure 17:
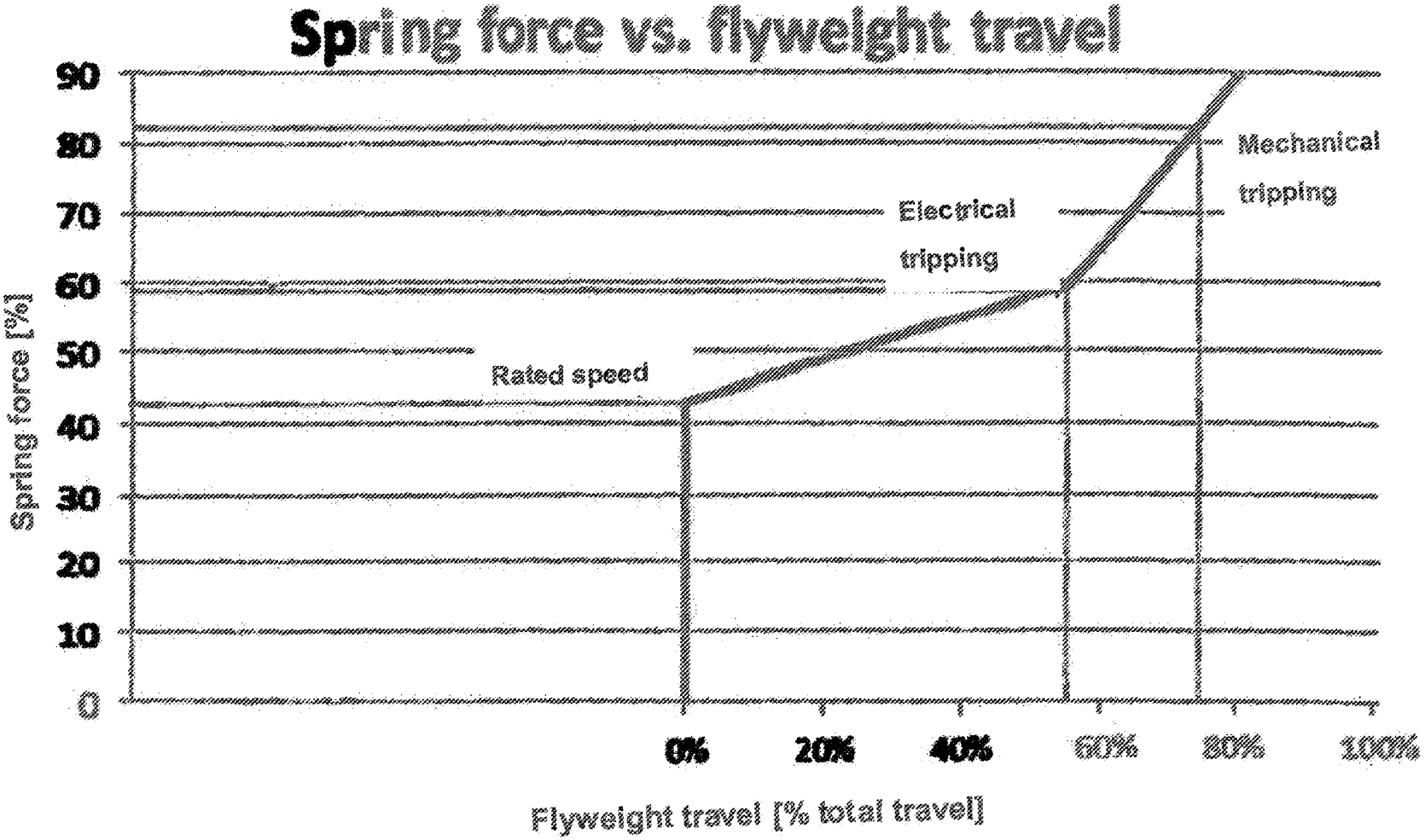

FIG. 17 shows the general physical behaviour of the centrifugal force as a function of the lift speed. The centrifugal force is identical to the product of the mass of the centrifugal weight multiplied by the square speed of rotation multiplied by the radial distance of the centrifugal weight from the axis of rotation:

$$F_z = m * \omega^2 * r$$

The centrifugal forces of the centrifugal weight 8*a*, 8*b* can vary depending on the design. Appendix FIG. 17 shows the basic course of the centrifugal force as a function of the lift speed. The values shown there are for illustration purposes only and must be adjusted depending on the design and local standard requirements.

Up to a defined speed, which is preferably just above the nominal speed, i.e. the usual operating speed of the lift, the centrifugal force increases with the square of the (angular) speed omega, since up to this point there is no outward movement of the centrifugal weights 8*a*, 8*b*. If this speed is exceeded, in addition to the increasing speed, the distance r of the centre of mass of the centrifugal weights 8*a*, 8*b* from the axis of rotation also increases and the centrifugal force rises disproportionately accordingly, since the counterforce caused by the first spring 11 is no longer able to prevent the movement of the centrifugal weight.

This results in the centrifugal force increasing to an ever greater extent for the same absolute increase in speed. In contrast, the counterforce, for example by springs 11, increases only linearly with the movement of the centrifugal weights 8*a*, 8*b* in some design embodiments. This leads to the fact that in the higher speed range the sensitivity of the overspeed governor 1 increases with respect to the trigger speed and the adjustment of the overspeed governor 1 in a defined range becomes increasingly difficult. This is particularly evident when the centrifugal force acting from the centrifugal weight 8*a*, 8*b* is transferred to the necessary spring force to represent the centrifugal weight movement required for this.

Figure 18:
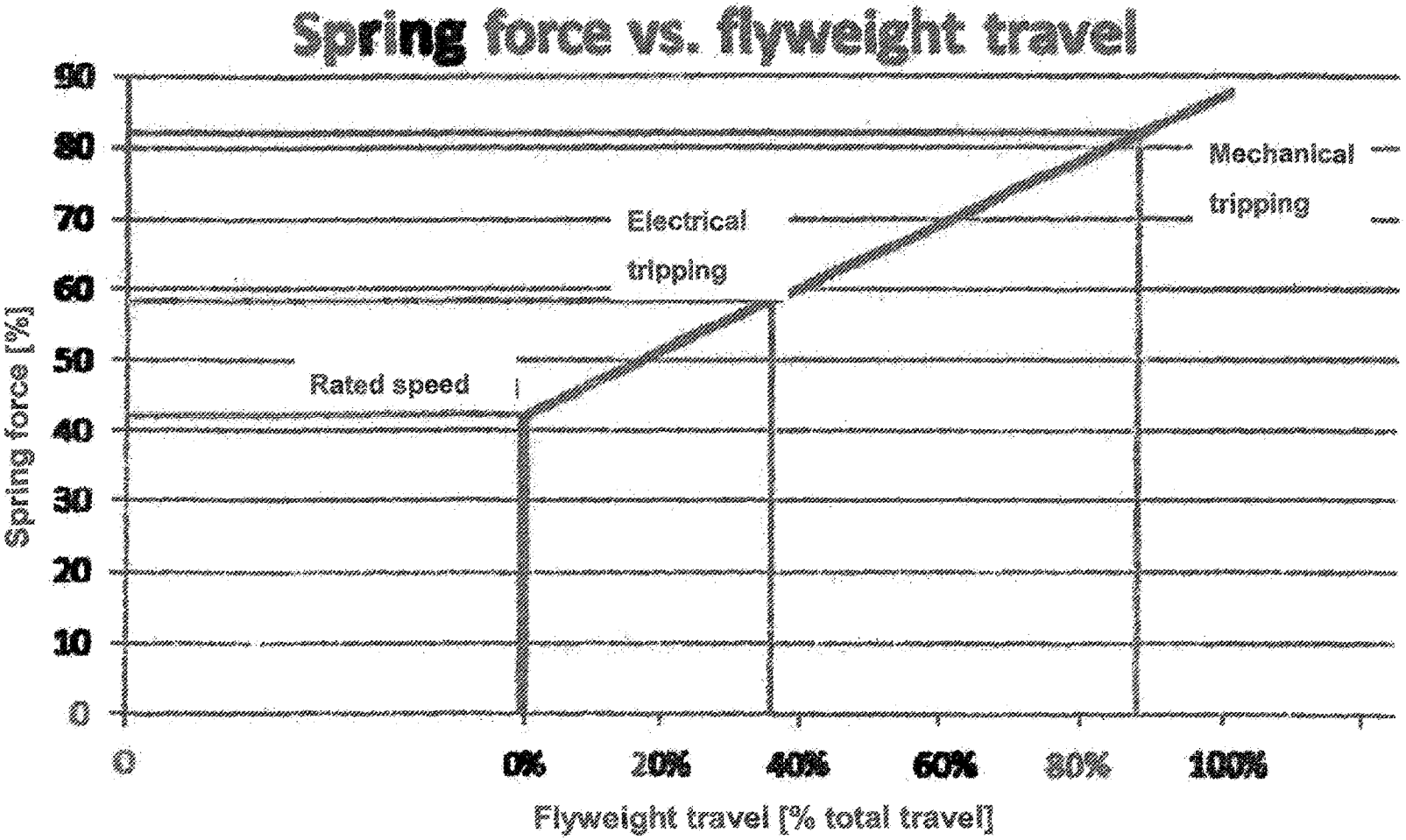

In FIG. 18 the spring force is plotted over the travel due to the centrifugal force of one of the centrifugal weights 8*a*, 8*b*. By preloading the first spring 11, the centrifugal weights 8*a*, 8*b* do not move until at least about nominal speed (preferably about 2%-3% above). The spring force increase, which is necessary to get from the electrical switching speed to the mechanical switching speed, requires a large part of the travel of the centrifugal weights 8*a*, 8*b*. However, since, as can be seen particularly well in FIG. 17, the force increases disproportionately, especially at high angular velocities, a clean adjustment of the means 20 for detecting electrical and mechanical switching speed is difficult. In addition, the travel distance is often limited.

In FIG. 19 the spring force is plotted over the travelling distance due to the centrifugal force of one of the centrifugal weights 8*a*, 8*b*, whereby a non-linear spring or first a first spring 11 and then a second spring 13 connected to the first spring gives the characteristic curve. The second spring 13 is active as soon as the electrical switching speed is reached. Due to the additional spring force of the second spring 13, the characteristic curve becomes steeper from this point onwards, which leads to a reduction in the necessary centrifugal weight movement between the electrical switching speed and the mechanical switching speed compared to a system according to FIG. 18. In addition, with the pretension of the first spring 11 and the time at which the second spring 13 becomes active, the two trigger points (electrical and mechanical switching speed) of the overspeed governor 1 can be set more easily independently of each other.

Figure 20:
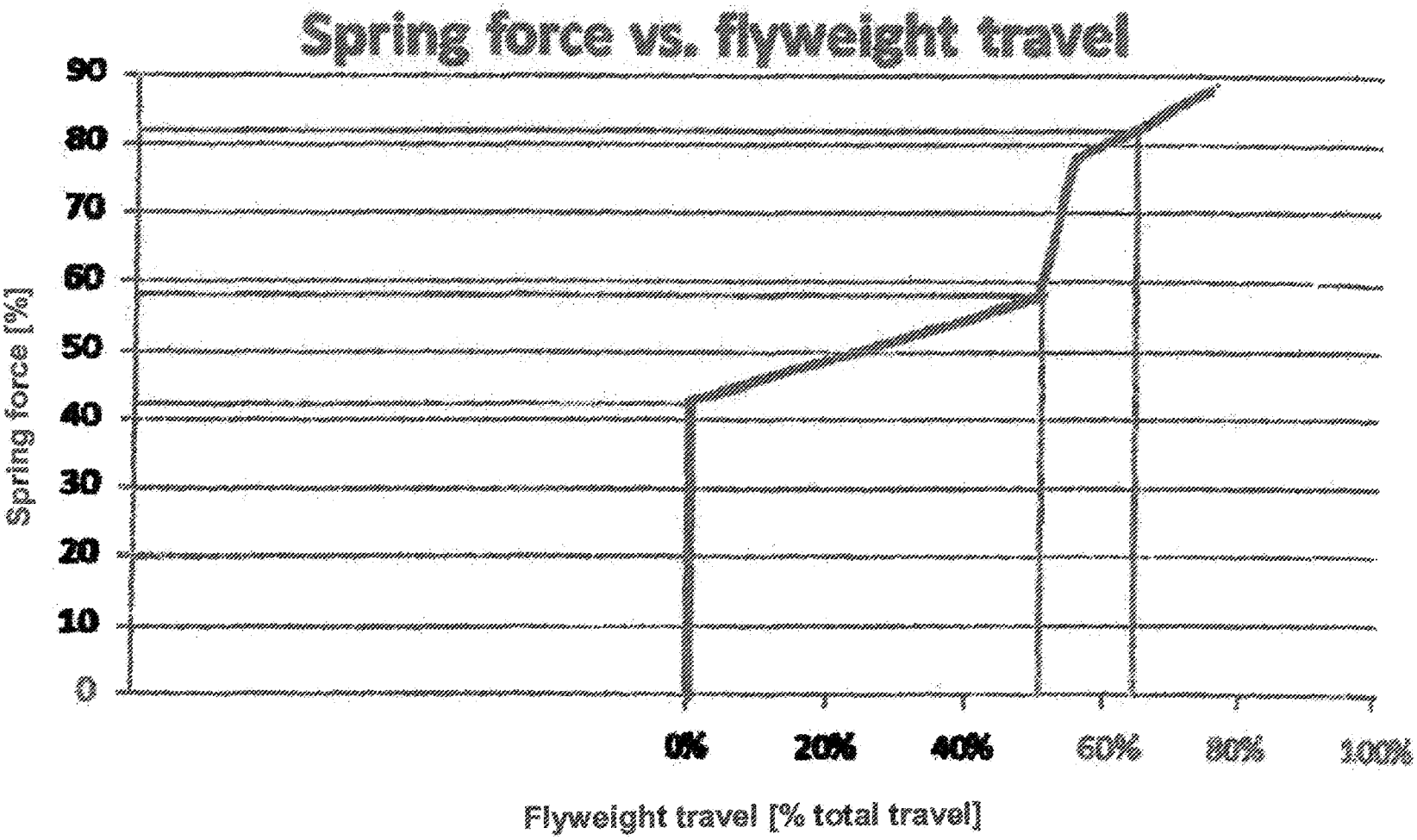

FIG. 20 shows a particularly preferred example. In FIG. 20, the second spring 13 is preloaded, for example against a stop 29. From the electrical switching speed, i.e. when the second spring 13 transmits a spring force, a quasi abrupt increase in the spring characteristic curve is produced by the pretension. As a result, the path saving of the centrifugal weight 8*a*, 8*b* can be further optimised, in particular reduced. Furthermore, the second spring 13 can have a spring characteristic with a flat curve, i.e. with a low spring constant D2. In particular, the spring constant of the second spring 13 is lower than that of the first spring 11. Thus, after the force increase induced by the preload, a flat characteristic curve can again be displayed, the gradient of which is only slightly greater than the gradient of the characteristic curve of the first spring 11. Thus, in this range, too, adjustment can again be made without any particular sensitivity.

CONCLUDING REMARKS OF A GENERAL NATURE

Independent protection is also claimed for an overspeed governor having the features of one or more of the following paragraphs, which may optionally be combined with features from one or more of the already established subclaims and/or with further features from the description.

An overspeed governor (1) for a lifting gear, in particular a lift installation, which is actuated by centrifugal force against the forces of a spring system and which has a first switching speed, above which it engages a brake, preferably in the form of a brake which brakes the traction sheave or traction sheave shaft, and a second, higher switching speed, on reaching which it itself preferably brakes or blocks and then applies tension to the overspeed governor cable, characterised in that the spring system has a first spring constant (D1) up to the said first switching speed or preferably in any case up to its close range (+/−20%), in that the spring system then has a second spring constant (D2), and in that the second spring constant (D2) is greater than the first spring constant (D1). is.

Overspeed governor according to the preceding paragraph, characterised in that the spring system has at least one pair of springs, of which the first spring represents the first spring constant alone, while the second spring is fastened with play in such a way that in the region of at least one of its ends it initially does not yet have any contact with a component against which it can exert a force, and the second spring is at the same time fastened in such a way that it comes to bear against the first spring at both ends as a result of the centrifugal force-induced displacement of at least one component of the overspeed governor and then represents the second spring constant together with the first spring.

Overspeed governor according to the two preceding paragraphs, characterised in that the spring system has at least one pair of springs, of which one spring is a helical spring and the other spring is a leg or torsion spring, i.e. a spring with a central cylindrical winding from which legs project which twist this winding.

Overspeed governor according to one of the three preceding paragraphs, characterised in that the leg or torsion spring is penetrated by a retaining mandrel.

Overspeed governor according to one of the four preceding paragraphs, characterised in that the leg or torsion spring is adjusted in its pretension and/or the time at which it becomes effective by shifting the support point of one of the legs.

LIST OF REFERENCE SIGNS

H Main axis
N Secondary axis
1 Overspeed governor
2 Supporting structure
3 Axle stub
4 Sheave
5 Brake rotor
6 Bearing bolt
7*a*, 7*b* Eccentric pieces
220 Coupling bolt bore
2200 Coupling bolt
8*a*, 8*b* Centrifugal weights
9 undeflected position
10 Reset unit
11 not given in FIG. (first spring as a whole)
12*a*, 12*b* first individual spring
13 not given in FIG. (second spring as a whole)
14*a*, 14*b* second individual spring
15*a*, 15*b*, 15*c*, 15*d* Spring end
16 Spring support
17*a*, 17*b*, 17*c*, 17*d* Spring end
18*a*, 18*b* Eccentric bolt
19 Lock nut
20 Means
21 Guide plate
22 Spring holder
23 Elongated hole
24 Receiving groove
25 Base surface
26 Aperture
27 first end surface
28 second end surface
29 Stop
30 Guide groove
31 Bore
32 Elongated hole

The invention claimed is:

1. An overspeed governor for a lifting gear, on its side comprising:

a sheave rotating in both a clockwise direction and a counterclockwise direction about a main axis and driven by an overspeed governor rope, and a brake for braking the sheave, the brake comprising:

at least one eccentric piece, a first centrifugal weight, and a second centrifugal weight, the at least one eccentric piece being mounted pivotably on the first centrifugal weight and pivotably on the second centrifugal weight, wherein, in response to a displacement of the first and second centrifugal weights, the first and second centrifugal weights pivot the at least one eccentric piece, the brake further comprising a reset unit with a spring system which pulls the centrifugal weights in a direction of their undeflected position with a spring force provided by the spring system, and the spring system has a first spring constant up to an electrical switching speed of the sheave, and the spring system has in both rotating directions of the sheave a second spring constant from the electrical switching speed of the sheave that is greater than the first spring constant.

2. The overspeed governor according to claim 1, wherein the first spring constant is constant.

3. The overspeed governor according to claim 1, wherein the second spring constant is constant.

4. The overspeed governor according to claim 1, wherein the spring system comprises a first spring with the first spring constant and a second spring, the second spring constant resulting from an interaction of the spring constants of the first spring and the second spring.

5. The overspeed governor according to claim 4, wherein the first spring is a compression spring and is supported at a first spring end on the first centrifugal weight, and the first spring is supported at a second spring end on a spring support that is operatively connected to the second centrifugal weight.

6. The overspeed governor according to claim 4, wherein the second spring is a tension spring that is attached at a first spring end to the first centrifugal weight, and the second spring is attached at a second spring end to the second centrifugal weight.

7. The overspeed governor according to claim 4, wherein a stop bolt is attached to one of the first and second centrifugal weights and the stop bolt serves as a stop for the second spring.

8. The overspeed governor according to claim 7, wherein the stop bolt is designed as an eccentric bolt.

9. The overspeed governor according to claim 4, wherein the second spring is preloaded.

10. The overspeed governor according to claim 9, wherein the second spring is fastened to a spring holder adjustably mounted on the at least one eccentric piece, and a pretension of the second spring is adjustable by adjusting the spring holder.

11. The overspeed governor according to claim 4, wherein one end of the second spring is movable in an elongated hole up to the electrical switching speed, and the elongated hole is arranged in one of the first and second centrifugal weights.

12. The overspeed governor according to claim 4, wherein the first spring is preloaded to such an extent that centrifugal forces occurring move the centrifugal weights only from a speed of at most about 10% above a nominal speed occurring in normal driving operation.

13. A conveyor with a car guided on guide rails, a drive system and a braking device cooperating with the guide rails for ending an impermissible state of movement of the car as well as the overspeed governor according to claim 1 for triggering the braking device.

14. An overspeed governor for a lifting gear, on its side comprising:

a sheave rotating about a main axis and driven by an overspeed governor rope, and a brake for braking the sheave, the brake comprising:
at least one eccentric piece,
a first centrifugal weight, and
a second centrifugal weight, the at least one eccentric piece being mounted pivotably on the first centrifugal weight and pivotably on the second centrifugal weight, wherein, in response to a displacement of the first and second centrifugal weights, the first and second centrifugal weights pivot the at least one eccentric piece, the brake further comprising a reset unit with a spring system which pulls the centrifugal weights in a direction of their undeflected position with a spring force provided by the spring system, and the spring system has a first spring with a first spring constant up to an electrical switching speed of the sheave, and the spring system has a second spring, and a second spring constant from the electrical switching speed of the sheave that is greater than the first spring constant, wherein the second spring constant results from an interaction of the spring constants of the first spring and the second spring, and wherein the second spring is a leg spring, with a first leg supported on the at least one eccentric piece, and a second leg supported on one of the first and second centrifugal weights from at least the electrical switching speed rotational speed.

15. An overspeed governor for a lifting gear, on its side comprising:

a sheave rotating about a main axis and driven by an overspeed governor rope, and a brake for braking the sheave, the brake comprising:
at least one eccentric piece,
a first centrifugal weight, and
a second centrifugal weight, the at least one eccentric piece being mounted pivotably on the first centrifugal weight and pivotably on the second centrifugal weight, wherein, in response to a displacement of the first and second centrifugal weights, the first and second centrifugal weights pivot the at least one eccentric piece, the brake further comprising a reset unit with a spring system which pulls the centrifugal weights in a direction of their undeflected position with a spring force provided by the spring system, and the spring system has a first spring with a first spring constant up to an electrical switching speed of the sheave, and the spring system has a second spring, and a second spring constant from the electrical switching speed of the sheave that is greater than the first spring constant, wherein the second spring constant results from an interaction of the spring constants of the first spring and the second spring, and wherein the brake comprises two eccentric pieces pivotally mounted on the sheave, each of the eccentric pieces being pivotally mounted on the first centrifugal weight and pivotally mounted on the second centrifugal weight, the first and second centrifugal weights pivoting the eccentric pieces in response to a displacement of the first and second centrifugal weights due to centrifugal force, wherein the first spring comprises two first individual springs, and each of the first individual springs is connected at a first spring end to one of the first and second centrifugal weights, and each of the first individual springs is supported at a second spring end on a spring support, the two first individual springs being operatively connected to one another via the spring support, and the second spring consists of two second individual springs, and from at least the electrical switching speed, each of the second individual springs is supported at a first spring end on one of the first and second centrifugal weights and at a second spring end on a respective eccentric piece.

16. An overspeed governor for a lifting gear, which is actuated by centrifugal force against forces of a spring system and which has a first switching speed, above which the overspeed governor engages a brake, and a second, higher switching speed, above which the overspeed governor brakes or blocks and then applies tension to an overspeed governor cable, in order to trigger at least one further measure, wherein the spring system has a first spring constant up to the first switching speed or at least up to +/−20% of the first switching speed, and the spring system has a second spring constant that is greater than the first spring constant, wherein the spring system has at least one pair of springs, of which one spring is a helical spring and the other spring is a torsion spring with a central cylindrical winding from which legs project which twist the winding.

17. The overspeed governor according to claim 16, wherein the spring system has at least one pair of springs, of which a first spring represents the first spring constant alone, while a second spring is fastened with play in such a way that, in a region of at least one of its ends, the second spring initially does not yet have any contact with a component against which the second spring can exert a force, and the second spring is at the same time fastened in such a way that, as a result of a centrifugal force-induced displacement of at least one component of the overspeed governor, the second spring comes to bear against forces of the first spring at both ends and then represents the second spring constant together with the first spring.

18. The overspeed governor according to claim 15, wherein the torsion spring is penetrated by a retaining mandrel.

19. The overspeed governor according to claim 15, wherein a pretension of the torsion spring and/or a time at which the torsion spring becomes effective is adjusted by displacing a support point of one of the legs.

* * * * *